US012708836B2

(12) United States Patent
Gastel et al.

(10) Patent No.: US 12,708,836 B2
(45) Date of Patent: Aug. 18, 2026

(54) ICE SKATING RINK STRUCTURE AND METHOD

(71) Applicants: Dylan Gastel, Sandy, UT (US); Jason Stricker, West Newton, MA (US); Edward Fu, Sammamish, WA (US)

(72) Inventors: Dylan Gastel, Sandy, UT (US); Jason Stricker, West Newton, MA (US); Edward Fu, Sammamish, WA (US)

(73) Assignee: Dylan Gastel, Sandy, UT (US)

( * ) Notice: Subject to any disclaimer, the term of this patent is extended or adjusted under 35 U.S.C. 154(b) by 101 days.

(21) Appl. No.: 18/427,139

(22) Filed: Jan. 30, 2024

(65) Prior Publication Data

US 2024/0165490 A1 May 23, 2024

Related U.S. Application Data

(63) Continuation-in-part of application No. 18/211,082, filed on Jun. 16, 2023, which is a continuation of (Continued)

(51) Int. Cl.
*A63C 19/10* (2006.01)
*E01C 13/10* (2006.01)

(52) U.S. Cl.
CPC ..... *A63C 19/10* (2013.01); *E01C 13/102* (2013.01); *A63C 2203/10* (2013.01)

(58) Field of Classification Search
CPC .... A63C 19/10; A63C 2203/10; E01C 13/102

(Continued)

(56) References Cited

U.S. PATENT DOCUMENTS 2,869,692 A 1/1959 Hassett
2,972,173 A 2/1961 Weber (Continued)

FOREIGN PATENT DOCUMENTS

CA 2281158 11/2000
CA 2469608 10/2005

(Continued)

OTHER PUBLICATIONS

NiceRink Catalog, 2006-2007.

(Continued)

*Primary Examiner* — Anita M King
(74) *Attorney, Agent, or Firm* — Robinson & Cole LLP

(57) ABSTRACT

A retaining wall system for elevating a retaining wall panel of a portable ice skating rink. The retaining wall system includes a first support member and a second support member spaced apart from the first support member. The retaining wall system includes a flexible sheet extending between the first support member and the second support member. The retaining wall system includes a water impermeable liner supported by the flexible sheet. A support member for elevating a retaining wall panel of a portable ice skating rink. The support member includes a base arrangement configured to engage a mounting surface and a height elevating section extending from the base arrangement. The height elevating section having a first receiving area configured to receive a wall panel. A surface extends between the base arrangement and the height elevating section. The surface has a plurality of mounting areas configured to receive a lateral brace member.

22 Claims, 22 Drawing Sheets

Related U.S. Application Data application No. 16/313,606, filed as application No. PCT/US2017/040419 on Jun. 30, 2017, now Pat. No. 11,712,617.

(60) Provisional application No. 63/442,278, filed on Jan. 31, 2023, provisional application No. 62/356,842, filed on Jun. 30, 2016.

(58) Field of Classification Search
USPC ..... 248/126; 62/235; 472/90
See application file for complete search history.

(56) References Cited

U.S. PATENT DOCUMENTS

| | | | | |
|---|---|---|---|---|
| 3,120,376 | A | 2/1964 | Case | |
| 3,274,621 | A | 9/1966 | Diemond et al. | |
| 3,409,916 | A | 11/1968 | Billig et al. | |
| 3,530,512 | A | 9/1970 | McBride et al. | |
| 3,770,245 | A | 11/1973 | Murdock | |
| 3,771,891 | A | 11/1973 | Nirenski et al. | |
| 3,844,539 | A | 10/1974 | Abbott | |
| 3,930,647 | A | 1/1976 | Berlemont | |
| 4,392,647 | A | 7/1983 | Golebieski | |
| 4,502,816 | A * | 3/1985 | Creter, Jr. | E02B 3/06 D12/217 |
| 4,676,762 | A | 6/1987 | Ballard | |
| 4,905,970 | A | 3/1990 | Holmsten et al. | |
| 4,927,134 | A | 5/1990 | Burley | |
| 5,134,857 | A | 8/1992 | Burley | |
| 5,489,165 | A * | 2/1996 | Smith | E04H 4/0043 405/262 |
| 5,702,090 | A | 12/1997 | Edgman | |
| 5,706,625 | A | 1/1998 | Vallance et al. | |
| 5,820,470 | A | 10/1998 | Saunders | |
| 5,953,882 | A | 9/1999 | Vallance et al. | |
| 5,988,599 | A | 11/1999 | Forbis | |
| 6,004,218 | A | 12/1999 | Keating et al. | |
| 6,230,451 | B1 | 5/2001 | Stoller | |
| 6,315,495 | B1 * | 11/2001 | Starheim | E21B 21/01 405/129.75 |
| 6,739,088 | B1 | 5/2004 | Stoller | |
| 6,848,125 | B2 | 2/2005 | Vila Corts | |
| 6,901,697 | B1 | 6/2005 | Stoller | |
| 7,040,461 | B2 * | 5/2006 | Chrisco | B60T 3/00 D12/217 |
| 7,138,026 | B1 | 11/2006 | Stoller | |
| 7,828,263 | B2 * | 11/2010 | Bennett | E04G 13/00 249/219.1 |
| 8,689,511 | B2 | 4/2014 | Fleming, III | |
| 10,300,365 | B2 | 5/2019 | Merlot | |
| 10,718,133 | B1 | 7/2020 | Maher | |
| 11,712,617 | B2 | 8/2023 | Gastel | |
| 2003/0056907 | A1 | 3/2003 | Caveney et al. | |
| 2006/0038380 | A1 | 2/2006 | Howell et al. | |
| 2007/0145340 | A1 | 6/2007 | Brabeck et al. | |
| 2007/0287548 | A1 | 12/2007 | Irving et al. | |
| 2009/0137329 | A1 | 5/2009 | Palumbo et al. | |
| 2009/0154996 | A1 * | 6/2009 | Liner | E02B 3/04 405/35 |
| 2018/0318701 | A1 | 11/2018 | Merlot | |
| 2019/0022551 | A1 | 1/2019 | Doya | |
| 2021/0046376 | A1 * | 2/2021 | Gastel | E02D 29/0266 |
| 2021/0046377 | A1 * | 2/2021 | Gastel | A63C 19/10 |
| 2022/0282432 | A1 | 9/2022 | Stoller | |
| 2024/0245980 | A1 * | 7/2024 | Sévigny | A63C 19/10 |

FOREIGN PATENT DOCUMENTS

| | | | |
|---|---|---|---|
| CA | 2546229 | | 3/2007 |
| CA | 3029436 | A1 | 1/2018 |
| CA | 3099722 | A1 | 11/2019 |
| CA | 3150810 | | 9/2022 |

OTHER PUBLICATIONS

NiceRink Catalog, 2007-2008.
NiceRink Catalog 2008-2009.
NiceRink Catalog 2009-2010.
Steven Rushin, On Golden Ponds, Sports Illustrated, Jan. 30, 2006, pp.
Request for Ex Parte Patent Reexamination of U.S. Pat. No. 11,712,617, filed Dec. 3, 2024, pp. 1-115.
Office Action in Ex Parte Reexamination issued in corresponding U.S. Appl. No. 90/019,754, date mailed May 12, 2025, pp. 1-28.
International Search Report issued in corresponding PCT Application No. PCT/US2017/040419, dated Sep. 26, 207, pp. 1-2.
Examination Report issued in corresponding CA Application No. 3171755, date mailed Oct. 29, 2024, pp. 1-4.
Response to Non-Final Office Action filed Jul. 9, 2025 in related U.S. Appl. No. 18/211,082, pp. 1-11.
Response to Non-Final Office Action filed Jul. 11, 2025 in related U.S. Appl. No. 90/019,754, pp. 1-25.
Examination Report issued in corresponding CA Application No. 3227629, dated Sep. 12, 2025, pp. 1-4.
Examination Report issued in corresponding CA Application No. 3,090,078, dated Apr. 1, 2026, pp. 1-12.

* cited by examiner

ICE SKATING RINK STRUCTURE AND METHOD

CROSS REFERENCE TO RELATED APPLICATIONS

This application is a continuation in part of and claims priority to U.S. patent application Ser. No. 18/211,082 which is a continuation application of and claims priority to U.S. application Ser. No. 16/313,606 filed on Dec. 27, 2018, now U.S. Pat. No. 11,712,617, issued on Aug. 1, 2023, and U.S. Pat. No. 11,712,617 C1 Ex Parte Reexamination Certificate, issued on Oct. 31, 2025, which is a US National Stage Application of and claims priority to PCT Application PCT/US2017/040419, filed on Jun. 30, 2017, which in turn claims priority to U.S. Provisional Patent Application Ser. No. 62/356,842 filed on Jun. 30, 2016, the disclosures of which are incorporated by reference herein in their entirety.

This application also claims priority to U.S. Provisional Patent Application Ser. No. 63/442,278, filed on Jan. 31, 2023, the disclosure of which is incorporated by reference herein in its entirety.

TECHNICAL FIELD

A self-standing portable ice skating rink structure that does not penetrate the underlying surface and generally requires no tools or hardware for installation is provided. The ice skating rink structure comprises a combination of some or all of one or more side boards, one or more board holding members, one or more tension members and an impermeable liner. In one embodiment, a perimeter component is fitted with a water-filled impermeable liner and the perimeter component is held together by one or more tension members, such as straps with interlocking snaps or buckles. Each of the board holding members stand on the ground and can comprise a U-shaped slot or receptacle area for holding at least one board and can have at least one area for an aperture or receptacle for which to attach a tension member. The boards can also have one or more receptacles for tension members or board holding members. The tension members traverse the area of the enclosed rink and attach to board holding members or boards on opposite sides of the rink. The boards can comprise the perimeter of the ice skating rink structure. A plurality of interconnecting boards can also comprise the perimeter component. Alternatively, a plurality of interconnecting boards can be further connected with one or more corner connecting components or corner connectors to comprise the perimeter component. An alternative embodiment has boards and board holding members which are combined into one piece. A liner is placed over the tension members, up the walls of the boards, and covers the area of the rink. Into this liner water is poured, which freezes into ice by way of the temperature of the surrounding air or an optional refrigeration system placed under or inside the rink. Boards of different heights can be used for rinks built on unlevel ground. Because no component of the rink penetrates the surface under the rink, the rink can be installed on many different types of surfaces including, but not limited to, hard courts, parking lots, and frozen or unfrozen ground. If installed on a slope, optional spikes can be inserted into optional holes or receptacles in the board holding members.

BACKGROUND

Ice hockey and ice skating in general are increasingly popular in cold climates. The demand for ice time is so high compared with supply in many regions that teams and other clubs/groups must rent ice time during very early morning hours or very late nighttime hours. Many programs, especially those run by public high schools have been forced to reduce practice ice time hours or even eliminate entire programs due to increased costs to obtain ice time, particularly in view of reduced budgets.

Traditionally, hockey players and other skaters have used frozen lakes or ponds on which to skate during the winter months. In addition, families, towns and other associations have flooded fields or parking lots to form ice on which to skate. Skating on lakes and ponds can be extremely dangerous. Also, flooding a permeable field or lot is not feasible in regions where the ice will melt and then refreeze throughout the winter, as the water will drain once the ice intermittently melts.

There are presently many complicated methods for constructing an outdoor ice rink. These usually involve constructing some sort of perimeter inside of which an impermeable liner is optionally laid. This open-top container is then partially filled with water, which freezes into ice in the rough shape of an ice rink. These perimeters are usually constructed of some combination of plywood, lumber, spikes, stakes, screws and nails. The impermeable liners according to the prior art must be precisely custom made for each perimeter size and shape. Any damage to the liner, desired modification to the shape and/or size of the perimeter, or any manufacturing imperfections would render the liner unusable, wasting the material and requiring an entirely new liner.

There also exist some manufactured components made of plastic or metal that somewhat simplify the process. However, these systems either penetrate the ground and/or require hardware, sand bags, or some sort of hand-held or power tools to construct. There also exist inflatable structures, however these do not offer a solid board off which to bounce a puck, can be punctured by a skate, and are not modular or easily customizable.

Driving any sort of spike or stake into the ground requires immense force. When the ground is frozen or partially frozen, this can become virtually impossible for the average person. In addition, many people do not have the strength or experience with which to effectively hammer the stake or spike into unfrozen or frozen earth. The use of other tools and power tools—including but not limited to saws, hammers, drills, and screwdrivers—pose similar challengers to landowners who wish to install a rink on their property.

When the best space to install a rink covers wholly or partially a surface that cannot have spikes or stakes driven into it without damage, (i.e. tennis or sport courts, turf fields, parking lots), current methods and products cannot be used. In these cases, heavy sandbags or complicated reinforcements made of lumber are generally required to support the board holding members and/or boards. However, these designs are either too complicated, labor intensive, and/or expensive for the average person to handle or require the inconvenient lifting of many sandbags or other weights, or even specialized equipment such as drills, hammers and/or lumber. Rink designs that penetrate the ground also pose threats to expensive underground systems such as underground utilities and sprinkler systems.

It is apparent from the above that there is a need for providing a portable, free-standing skating rink that can be constructed, i.e. installed, easily on most surfaces without the need for additional tools or hardware, and that does not require penetration of the ground to secure the system.

SUMMARY

In accordance with the present invention, an ice skating rink structure is provided, comprising a combination of some or all of one or more side boards, one or more board holding members, one or more tension members, and an impermeable liner. Neither the board holding members nor the structure have members which insert or penetrate into the ground and the structure lies relatively flat on the ground. The board holding members comprise a slot, groove or other receptacle member, preferably U-shaped or squared off U-shaped, to hold the boards, generally in a vertical position. Tension members can then be used to attach to the board holding members or boards to traverse the rink to restrain the board holding members and boards from sliding or tipping from the force of the water and/or ice.

In one embodiment, the board holding members used to support the boards and attach to the board holding members are generally triangular in shape, have a U-shaped or squared-off U-shaped receptacle member to hold the boards, and an aperture or loop, hole or other member at which to attach the tension member. The board holding members or boards can also include a mechanical, magnetic or other member which is used to secure the top/edge of the impermeable liner. The board holding member has no downward projections and can sit relatively flat on any relatively flat surface. The supporting bracket or board holding member that holds the boards requires no tools or fasteners to hold the board(s) that it supports. The boards are provided in a variety of dimension, and in some embodiments are about 5 feet in length, and about 0.5 to 4 inches wide, and 6 inches to about 2 feet or greater in height.

In one embodiment, the board holding members include a base having no downward projections or spikes that would need to be driven into the ground. A support buttress or brace, optionally forming a hypotenuse of a triangular member, can be used to strengthen the board holding member that holds the board(s). Optionally, there also can be a hole or slot in the board holding member in which a rod, stake, spike or other member can be inserted, possibly into the ground, to hold the weight of the water inside of the structure.

The boards can have optional handles, indentations, grooves, holes, or apertures with which to facilitate ergonomic handling. Further, the boards can have an optional hole or other receptacle to which one or more tension members can optionally connect. The boards can include an optional supporting member that can optionally eliminate the need for some or all of the board holding members. There can optionally be included one or more clips, fasteners, U-clips, tapes, or other means for securing the liner to the boards, board holding members, or tension members (such as straps) of the rink.

The roughly rectangular rink can optionally have four roughly 90 degree corners, eight roughly 135 degree corners (to form a roughly octagonal rink perimeter shape), or some other combination. The corners can optionally include angled boards that cut off one or more corners of the rink to improve game flow on the rink. These corners of various angles can optionally be created by corner connectors similar to those in other embodiments, or by hinges, straps, or some other connection method.

There can optionally be one or more extension components to the boards, board holding members, such as nets that optionally attach netting or taller boards which optionally restrain pucks, players, or other objects within or outside the confines of the rink.

In one embodiment, the boards have two ends, one with an optional "male" connecting element such as a protuberance, and the other end with a "female" connecting element comprising one or more optional fingers and/or grooves, where the protuberance of the male connecting element of a side board interlocks (engages) with or slides into the female connecting element of an adjoining side board (the female connecting element receives the male connecting element) to form the perimeter of the rink. The female end of the board can optionally receive the male end in a vertical downward connecting movement. Alternatively, the male end of the board can optionally receive the female end in a vertically downward connecting movement.

The boards can be connected at the corners via a corner connector component which has a male connecting element comprising a protuberance and a female connecting element comprising a groove, where the male connecting element and the female connecting element are oriented at 90 degrees to one another or another selected angle, where the male connecting element of the corner connector interlocks (engages) with or slides into the female connecting element of a side board (the female connecting element of a side board receives the male connecting element of the corner connector) and the female connecting element of the corner connector interlocks (engages) with or receives the male connecting element (protuberance) of another side board to form a corner (or other angle) of the rink perimeter.

The present disclosure includes embodiments of an ice rink structure that is fast and easy to set up and take down. The rink can be assembled or installed on a variety of horizontal, flat, or semi-flat surfaces, including, but not limited to, grass, dirt, frozen ground, concrete, asphalt, or other paved or hard or soft surfaces. Unlike other products, the present invention and the preferred and alternative embodiments do not require staking into or penetrating the underlying surface. The present invention and the preferred and alternative embodiments solve this problem with a board holding member and strap (tension member) system which minimizes the risk of damage to the underlying surface(s) and/or buried utilities. The present invention and the preferred and alternative embodiments can be delivered in a self-contained kit with no additional tools or materials required for setup or takedown.

The side boards (panels) and board holding members allow for a variety of customizable sizes and configurations. The panels and board holding members are lightweight and strong. The tension members, such as a strap system, are convenient and eliminate the need for any tools or ground penetration. The liner receives the water and is optionally impermeable for longstanding use. The entire system allows for terrain differences (slope) of up to one foot or more across the area of the rink. The water self-levels due to gravity and optionally freezes into a flat ice surface.

The perimeter and tension member system allows the weight of the water on the one side of the perimeter component to be held up (supported/opposed) by the weight of the water on the opposing (or adjacent in some alternative embodiments) side of the perimeter component of the rink. The rink is self-standing and self-stabilizing. When the water freezes into ice, the weight of the ice on the tension member system and on the rink walls helps to lock the rink walls into place. The components of the rink can be stacked and stored in a compact area due to optional stacking nubs.

The rink is lightweight which helps for shipping, handling, and storage. The rink is reusable, and can be used from one year to the next.

Further, in accordance with the present invention a method of constructing an ice rink structure is described, including steps of placing the board holding members on the perimeter of the rink, unrolling the tension members on the ground and attaching them to the board holding members, placing the boards in the board holding members, placing a water-impermeable liner over the area of the rink and over the top of the boards, securing the liner to the boards, filling the rink with water, and allowing it to freeze. The boards and board holding members can be combined into one component or installation step. In this case, the boards are laid on the perimeter and straps are attached directly to the boards.

The disclosed ice skating rink structure presents numerous benefits over those known in the art. The disclosed ice skating rink structure does not require penetration of the underlying surface so that it can be installed on any surface at any time of year, on frozen and thawed ground. The disclosed ice skating rink structure can be used on level ground, sloped ground, as well as bumpy ground. The disclosed ice skating rink structure can be installed and removed without causing great damage to the underlying surface. The disclosed ice skating rink structure can be re-used from season to season. The disclosed ice skating rink structure requires no tools for installation. The disclosed ice skating rink structure can be set up without penetrating the ground and requires no compression members such as lumber or heavy sand bags to hold the board holding members, boards or liner in place.

The disclosed ice skating rink structure can be modified for use on sloped lawns as opposed to flat hard surfaces and the water-impermeable liner can be oversized to allow for adjustment of the liner and modification of the rink structure's size and/or shape. The disclosed ice skating rink structure can easily be constructed using boards made from either plastic, lumber, plywood, carbon fiber, fiberglass, composite or some other synthetic or other material. The disclosed ice skating rink structure can include boards which are used to form the perimeter of the rink with no holes, grooves or other modifications such as incorporating plywood boards or other inserts to allow them to connect with the provided board holding members.

A more detailed explanation of the ice rink structure is provided in the following description and claims and is illustrated in the accompanying drawings.

BRIEF DESCRIPTION OF THE DRAWINGS

FIG. 22 depicts an isometric view of multiple retaining wall elevating structures and retaining wall with a continuously extending flexible sheet secured to multiple retaining wall elevating structures and retaining walls.

DETAILED DESCRIPTION

Figure 1:
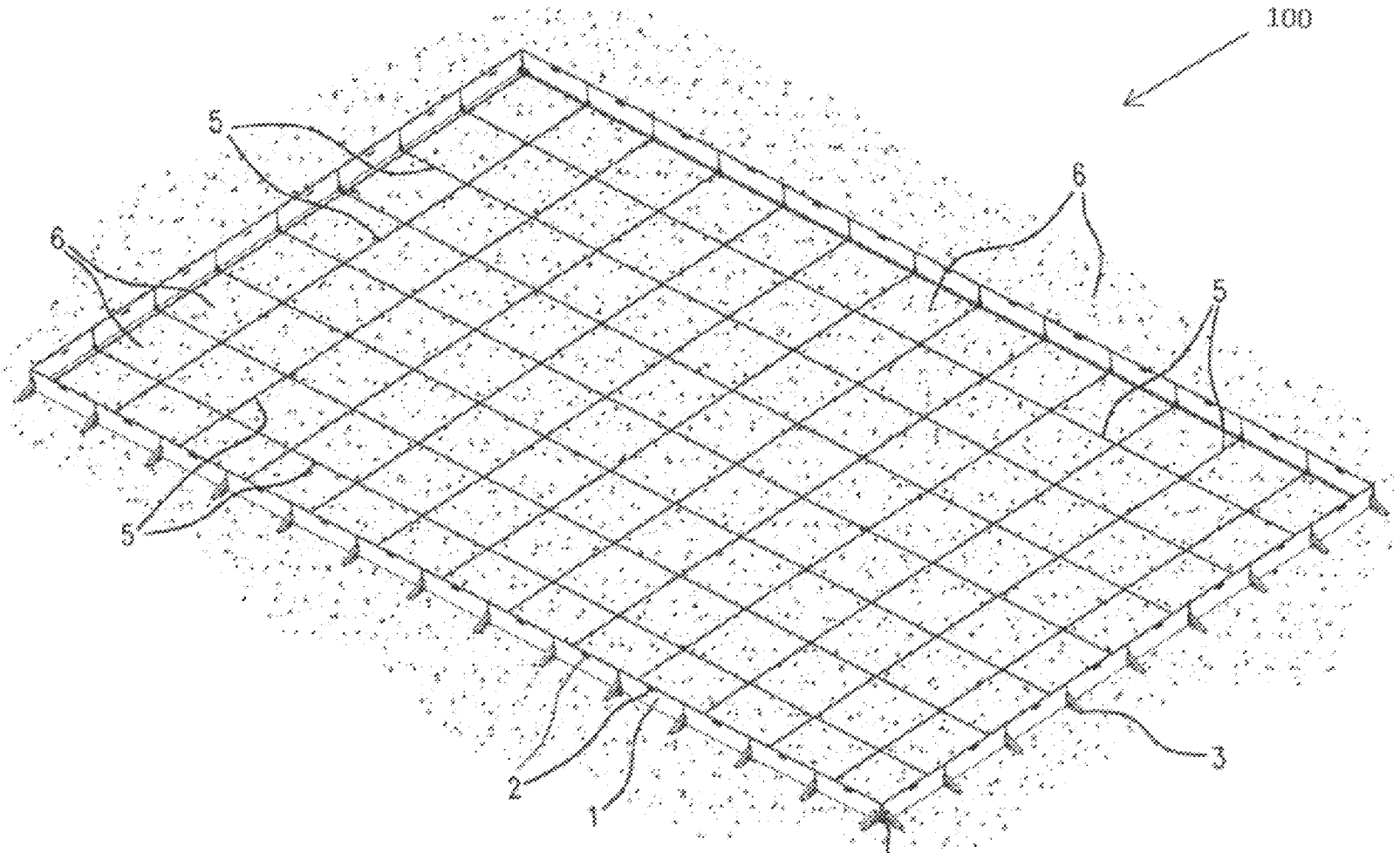
FIG. 1 is a perspective view of an ice skating rink structure according to the present disclosure with the impermeable liner and the water and/or ice omitted for clarity.
Figure 12:
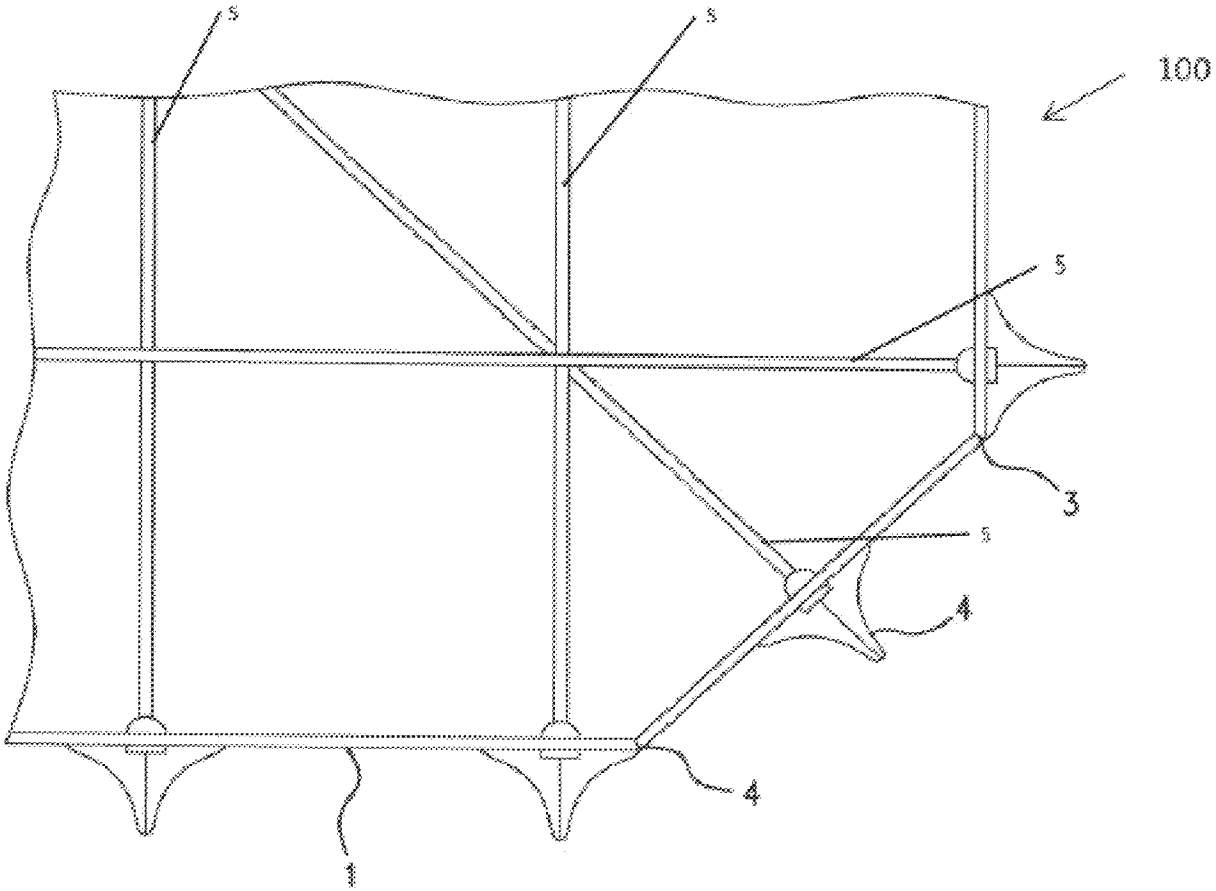
FIG. 12 is a partial plan view depicting an alternative embodiment of an ice skating rink structure according to the present disclosure with the impermeable liner and the water and/or ice omitted for clarity.

FIG. 1 depicts an assembled self-standing ice skating rink structure 100 of the present disclosure shown without the impermeable liner and without the water and/or ice. The ice skating rink structure 100 interlocking side boards 1, which, in some embodiments, are about 5 feet long, about 6 inches to 2 feet in height, and about 0.5 to 4 inches wide. In other embodiments, the boards have other dimensions. It should be noted that the side boards 1 are alternatively referred to as boards, panels, or side panels. In some embodiments, the side boards 1 are solid, hollow, or semi-hollow and include ridges or indentations on one or both sides to provide further structural integrity, strength, rigidity, and/or stability. In some embodiments, the side boards 1 include a side board aperture 2 (depicted in FIG. 1), which serve as a handle for transporting and positioning of the side board. In other embodiments, the side boards 1 include a permanently attached or detachable handle or an indentation under a groove that is formed into the side board or between two grooves that is formed into the side board to serve as a handle. FIG. 1 also depicts the board holding members 3. In the depicted embodiment, the board holding members 3 are each located at the junctions of the side boards 1 and near the corner edges of the side boards 1 at the corners of the ice skating rink structure 100. The depicted corner connecting components (or corner connectors) 4, each reversibly connect two adjacent side boards 1 to form a corner of the rink, and tension straps or tension members 5 secure the opposing side boards 1 of the assembled ice skating rink structure 100 a fixed distance from one another on the ground. The depicted tension members 5 traverse the length and width of the rink, directly contact the ground, run parallel to the side boards, and are positioned within the perimeter of the ice skating rink structure 100. In other embodiments, the tension members are mounted at a strap angle relative to the opposing side boards. FIG. 12 depicts an alternative embodiment in which some of the tension members 5 diagonally traverse an area 100A within the ice skating rink structure 100. In some embodiments, the board holding members are located at other positions on the side boards 1. The ice skating rink structure 100 depicted in FIG. 1 is installed on a horizontal surface 6. The depicted side boards 1 and corner connectors 4 define the perimeter of the ice skating rink structure 100.

Figure 2:
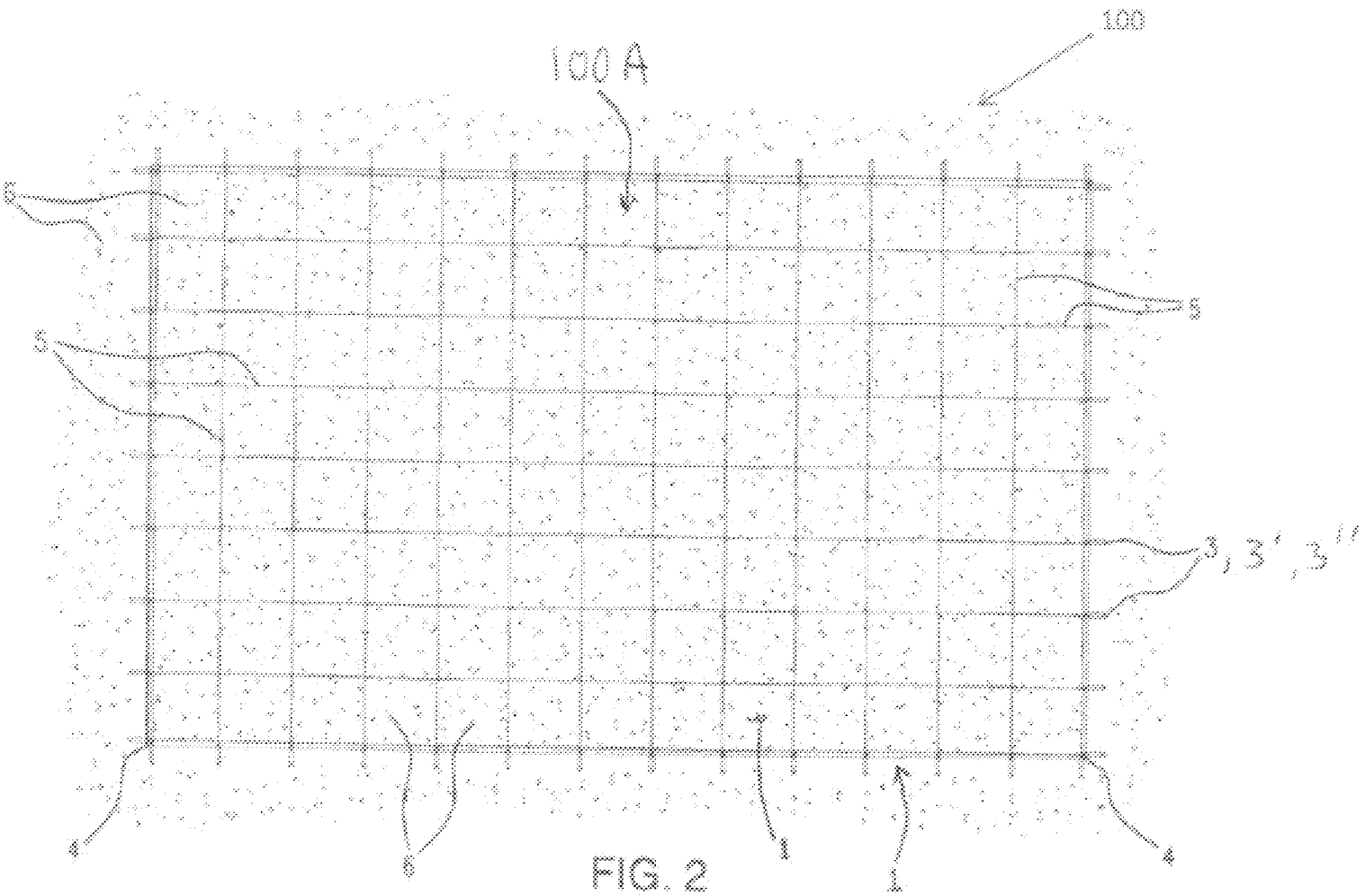
FIG. 2 is a plan view of the ice skating rink structure of FIG. 1.

Referring to FIG. 2, the interlocking side boards 1, the board holding members 3, and the corner connecting components 4 define the perimeter of the rink. Tension members 5 are secured to opposing side boards 1 of the assembled ice skating rink structure 100. A horizontal surface 6 is also illustrated.

Figure 3:
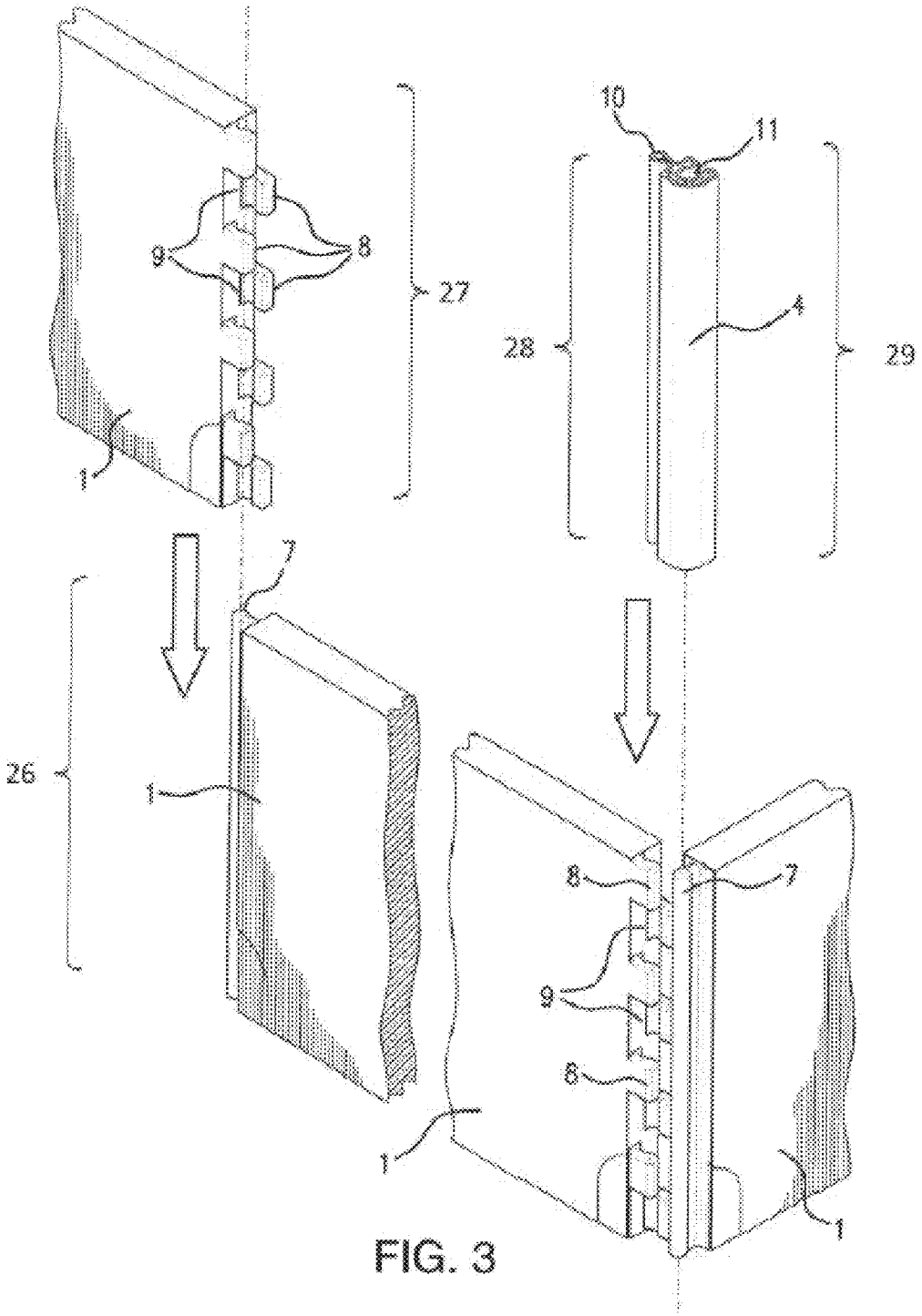
FIG. 3 is an exploded view depicting a portion of the side boards according to the present disclosure, including the corner connecting component.

Referring to FIG. 3, a male connecting element 26 of the side board 1 includes a protuberance 7 extending from one end of the side board, and a female connecting element 27 including fingers 8 and a groove 9 on the opposite end of the side board. The protuberance 7 of the male connecting element 26 of a side board interlocks (engages) with or slides into the female connecting element 27 of an adjoining side board (the female connecting element 27 receives the male connecting element 26) to form the sides of the perimeter of the rink. The depicted corner connecting component 4 has a male connecting element 28 comprising a protuberance 10 and a female connecting element 29 comprising a groove 11, where the protuberance 10 of the male connecting element 28 and the groove 11 of the female connecting element 29 are oriented at 90 degrees to each other. In some embodiments, the protuberance 10 of the male connecting element 28 and the groove 11 of the female connecting element 29 can be oriented at angles to each other than 90 degrees, e.g., 135 degrees. With respect to the corner connecting component 4, the male connecting element 28 of the corner connector 4 interlocks (engages) with or slides in to the female connecting element 27 of a side board (the female connecting element 27 of a side board 1 receives the male connecting element 27 of the corner connector 4) and the female connecting element 29 of the corner connector 4 interlocks (engages) with or receives the male connecting element 26 (protuberance 7) of another side board 1 to form a corner of the perimeter of the rink.

Figure 4:
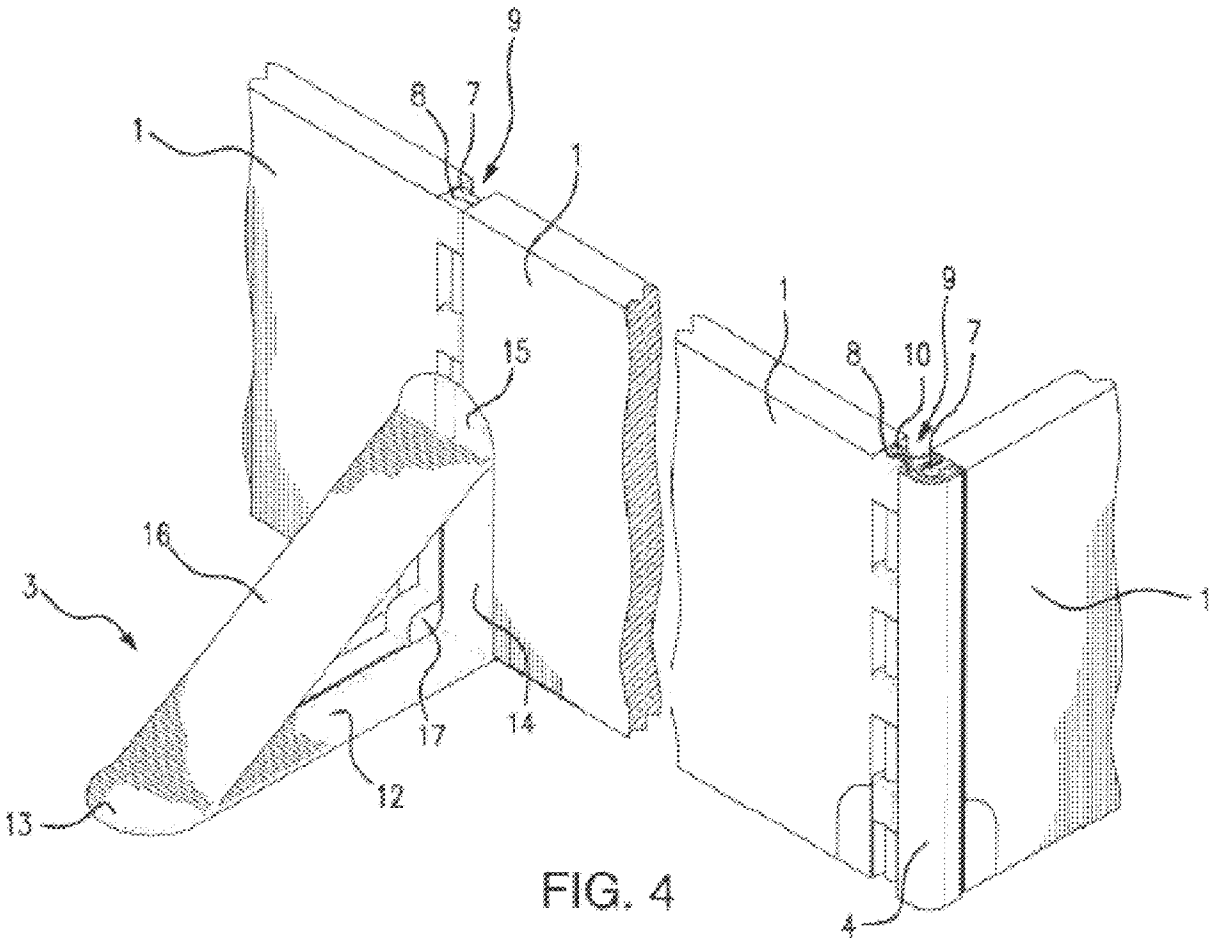
FIG. 4 is a partial perspective view of the side boards and corner connecting components of FIG. 3 in an assembled state including a board holding member.

Referring to FIG. 4, the side boards 1 are connected to each other and to the corner connecting component 4. The depicted side boards 1 slide into, i.e. are engaged with, and are supported by the board holding members 3. The depicted board holding members 3 include a base 12, an optional outer base extension 13, an outer vertical element 14, an optional extension of the outer vertical element 15, an optional supporting buttress 16, and an aperture (or loop or ring structure or receptacle or receiver) 17 for accepting and retaining the tension members 5. In other embodiments, the outer base extension 13 and/or the outer vertical element 15 are omitted. Further elements of the board holding members 3 are illustrated in FIGS. 5, 6, and 7.

Figure 5:
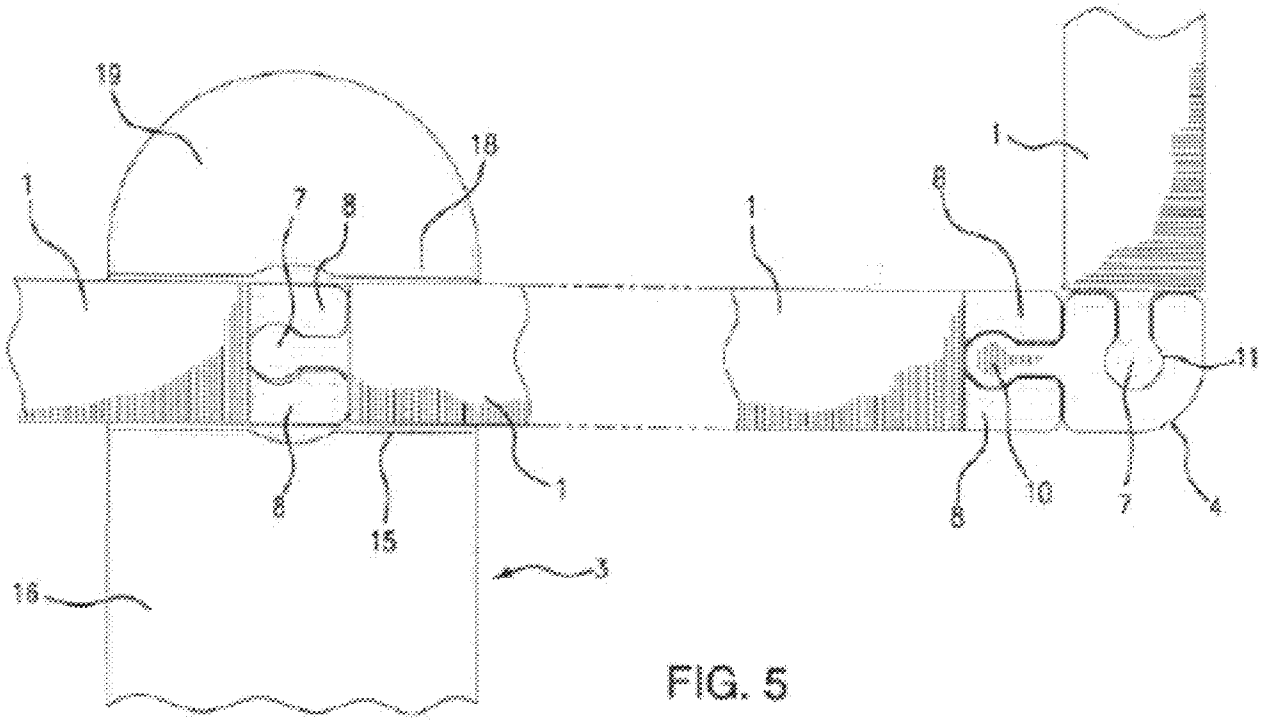
FIG. 5 is a partial plan view of the elements depicted in FIG. 4.

FIG. 5 depicts the connection between the side boards 1, the corner connecting component 4, and the board holding members 3 in greater detail. Specifically, the protuberance 10 of the corner connecting component 4 sliding into the fingers 8 of the side board 1, the groove 11 of the corner connector 4 engaging the sides of the protuberance 7 of the side board 1, the fingers 8 engage the sides of the protuberance 7 of the adjacent side boards 1, and the placement of the board holding member 3 between adjacent side boards 1. Also illustrated are the top surface of the optional outer vertical element 15 of the supporting bracket, the top surface of the supporting buttress 16 of the board holding member 3 (i.e., supporting bracket), the top surface of the inner vertical element 18 of the board holding member 3 (i.e., supporting bracket), and the top surface of the optional inner base extension 19 of the board holding member 3 (i.e., supporting bracket).

Figure 6:
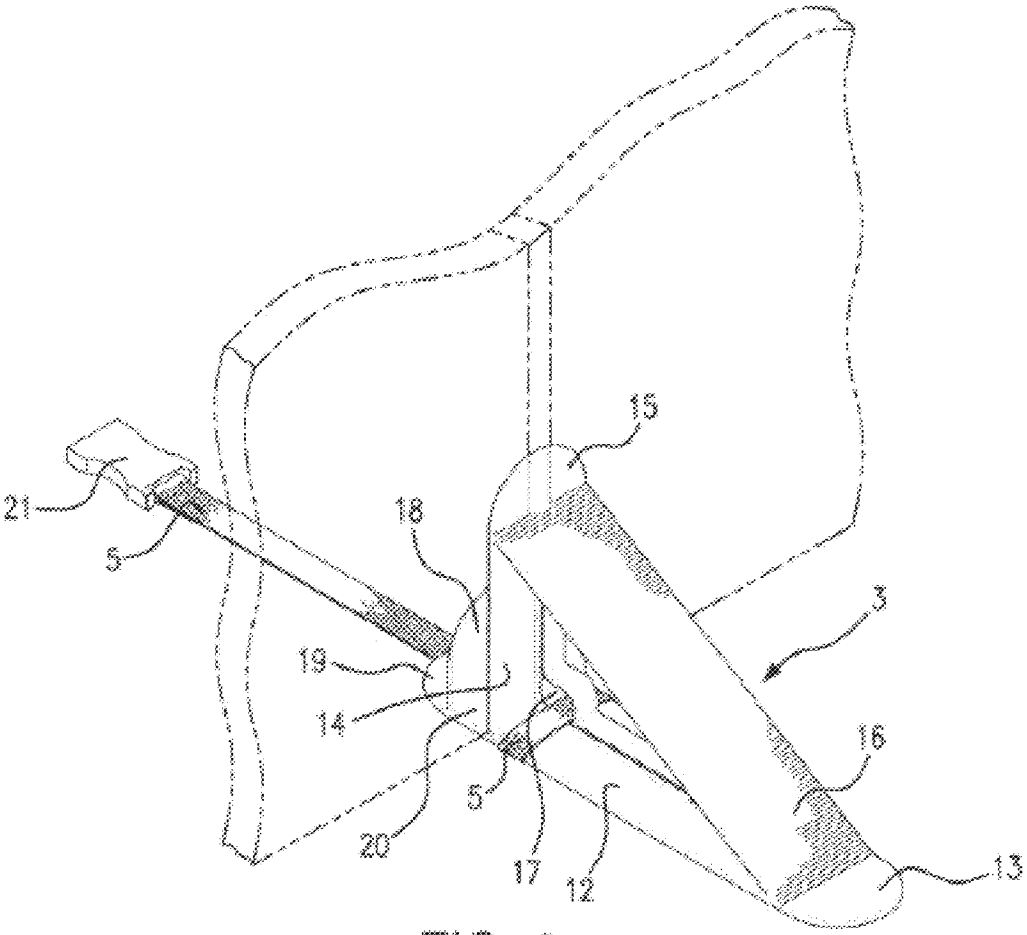
FIG. 6 is a perspective view depicting a board holding member according to the present disclosure and its engagement with the tension member with the remaining assembly shown in phantom for clarity.

FIG. 6 depicts the board holding member 3 and its engagement with the tension member 5. The side boards 1 are shown in phantom g to illustrate how they engage or slide into the board holding member 3. The depicted board holding member 3 also includes a base 12, an optional outer base extension 13, an outer vertical element 14, an optional extension of the outer vertical element 15, a supporting buttress 16, a foot 19, and an aperture 17 for accepting and retaining the tension member 5. An inner vertical element 18, the outer vertical element 14, and the base 12 define a slot 20. A connecting buckle is illustrated, which, in this embodiment, is a female connector portion 21 of the connecting buckle for engagement with a male connector portion 22 illustrated in FIG. 7, below.

Figure 7:
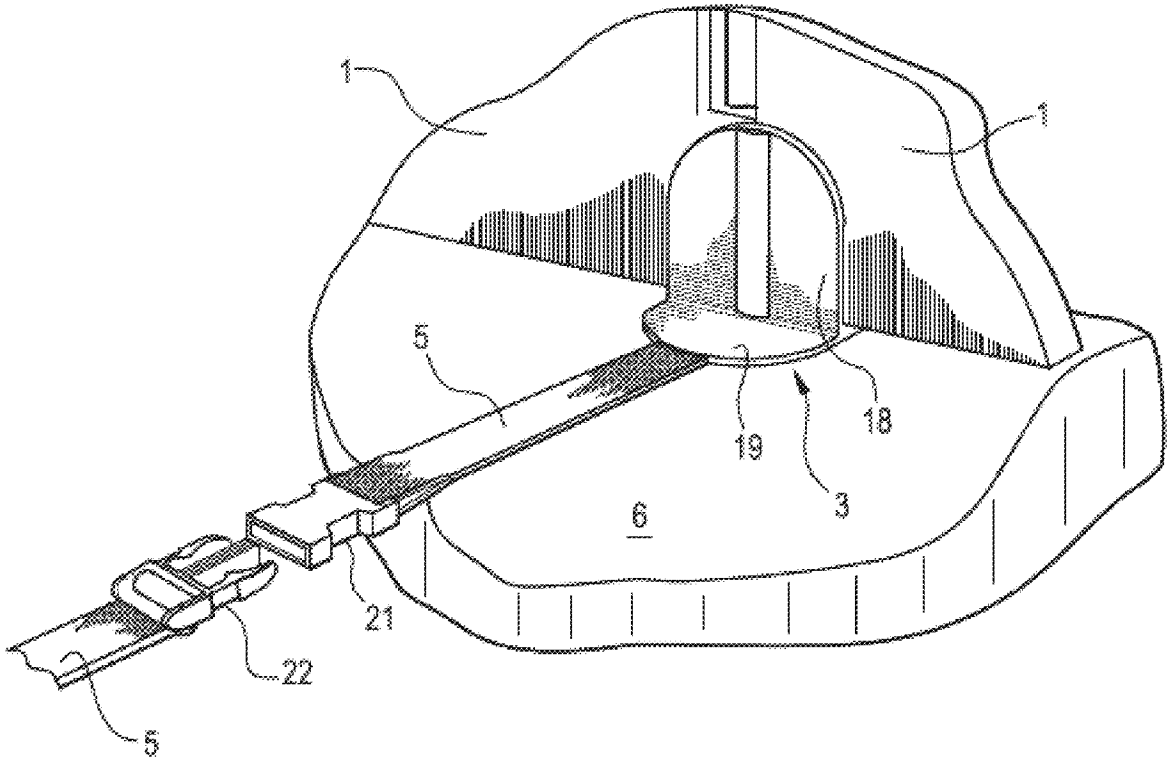
FIG. 7 is a perspective view from inside the rink depicting a board holding member according to the present disclosure and its engagement with side boards and a tension member.

FIG. 7 depicts the connection between the two portions of the tension member 5 and the board holding member 3 in greater detail. Both the female connector portion 21 and the male connector portion 22 of the tension member 3 are illustrated with the connector portions shown prior to engagement. The male connector portion 22 releasably mates with the female connector portion 21. In other embodiments, the connector portions 21, 22 are other adjustable, releasable, permanent or semi-permanent connectors. Also shown are the top surface of the inner vertical element 18 of the board holding member 3 (i.e., supporting bracket), and the top surface of the optional inner base extension 19 of the board holding member 3 (i.e., supporting bracket). The tension member 5 extends from the foot 19.

Figure 8:
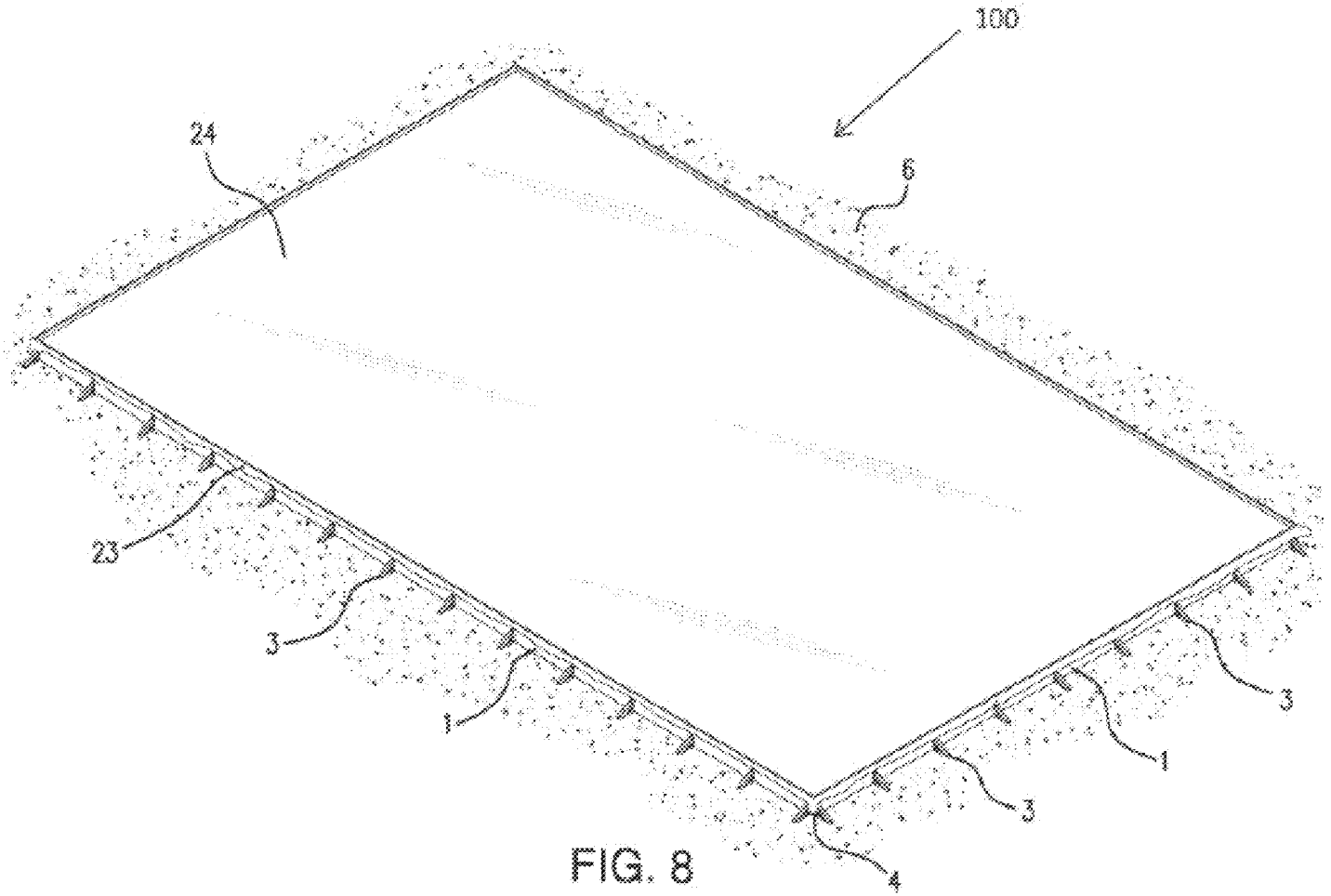
FIG. 8 is a perspective view from outside the rink of the ice skating rink structure of FIG. 1 including an impermeable liner and ice.

Referring to FIG. 8, an impermeable liner 23 is draped over the perimeter of the rink and water is frozen on the impermeable liner to form ice 24. The interlocking side boards 1, the board holding members 3, and the corner connectors 4 of the assembled ice skating rink structure 100 contain the water and allow it to freeze in place. In some embodiments, all or part of the water is poured into the impermeable liner before all of the aforementioned male connector portions are mated with the female connector portions. In the depicted embodiment, the impermeable liner 23 overlaps (e.g., excess or oversized liner hangs over) the side boards 1. A horizontal surface 6 is depicted beneath the ice rink. The boards and corner connectors define the perimeter of the rink. One benefit of the impermeable liner 23 overlapping the side boards 1 is that the shape of the impermeable liner 23 does not have to correspond to the shape of the perimeter of the rink. In some embodiments, the impermeable liner has a shape that is not complementary to the shape of the perimeter. In some embodiments, the impermeable liner is purposely larger than necessary to accommodate modification of the perimeter's shape and/or size.

Figure 9:
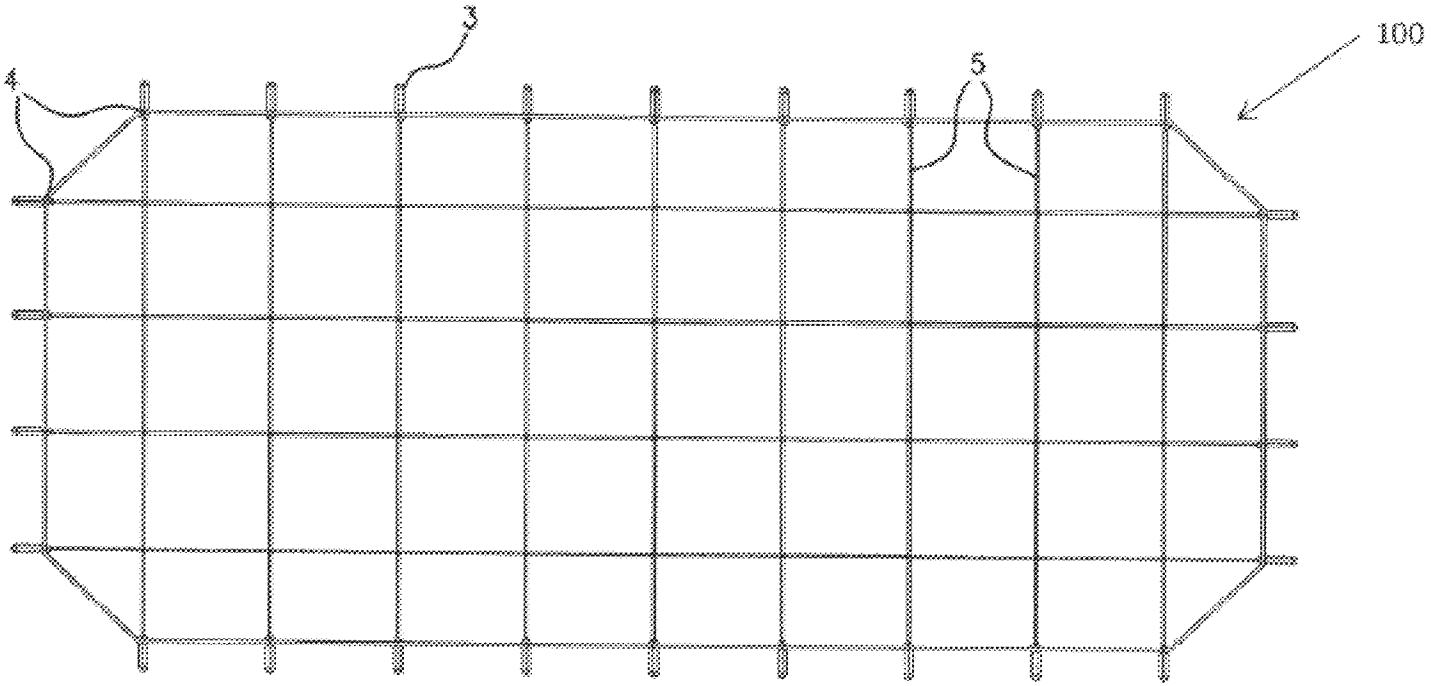
FIG. 9 is a plan view of an alternative embodiment of an ice skating rink structure according to the present disclosure with the impermeable liner and the water and/or ice omitted for clarity.

FIG. 9 depicts an alternative embodiment of the assembled self-standing ice skating rink structure 100 without the impermeable liner and without the water and/or ice. The perimeter defined by the interlocking side boards 1, the board holding members 3, corner connecting components 4, and tension members 5, secure the opposing side boards 1 of the four sides of the assembled ice skating rink structure 100. In this embodiment, an additional side board 1 is employed to form an interlocking corner, at 135 degrees to the adjacent sides. In some embodiments, the corners are formed at other angles.

Figure 10:
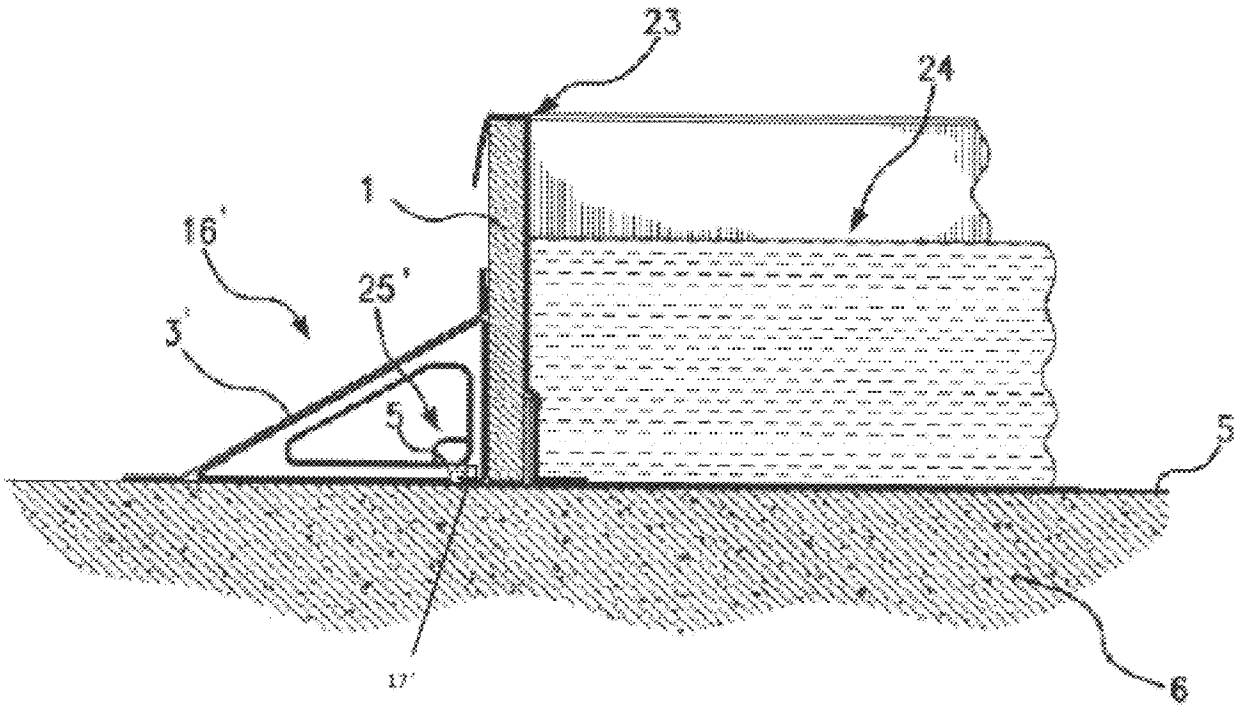
FIG. 10 is a side cutaway view of an alternative embodiment of a board holding member and side board according to the present disclosure.

FIG. 10 depicts an alternative embodiment of a board holding member 3' vertically supporting a side board 1. The water impermeable liner 23 is laid over the board and the tension member 5 is attached with clip 25' to the bottom of the board holding member 3'. In an alternative embodiment, the board holding member and board are a single piece. The depicted board holding member 3' includes an optional supporting buttress 16'. In the depicted embodiment, the weight of the ice 24 on the tension member 5 and side board 1 helps to stabilize the side board 1.

Figure 11A:
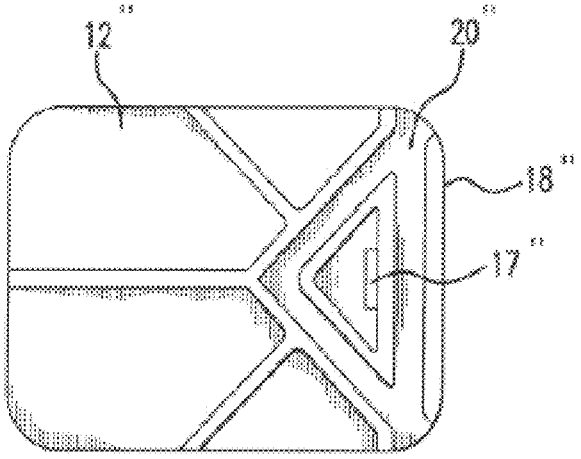
FIG. 11A is a plan view of an alternative embodiment of a board holding member according to the present disclosure.
Figure 11B:
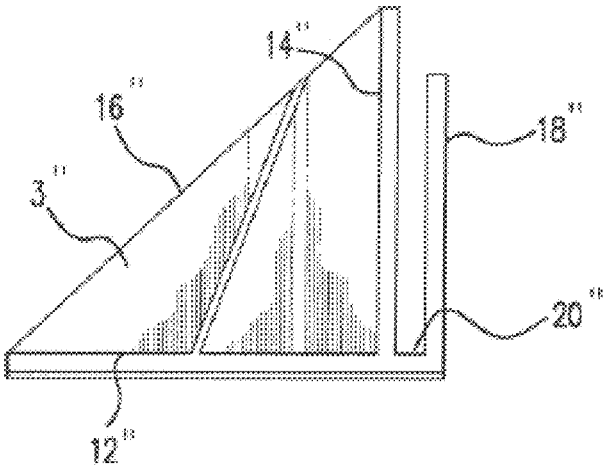
FIG. 11B is a cross sectional view of the board holding member of FIG. 11A.

FIGS. 11A and 11B depict an alternative embodiment for the board holding member 3". The board holding member 3" allows the boards to attach or connect at an angle of 90 degrees relative to one another. In other embodiments, this angle is straight (180 degrees) or at some other angle, for example 22.5, 45, 112.5, or 135 degrees. In some embodiments, the board holding member 3" includes slots 20" at different orientations. The depicted board holding member 3" comprises a base 12", an inner vertical element 18", an outer vertical element 14", a supporting buttress 16", and an aperture 17" (depicted in FIG. 11A) for accepting and retaining the tension members, which are not shown.

Referring to FIG. 12, an alternative embodiment of the assembled self-standing ice skating rink structure 100 includes side boards 1 forming the corner interlock at an angle other than 90 degrees. In this embodiment, the boards interlock at 135-degrees. In the depicted embodiment, the tension members 5 are oriented diagonally across the rink when corner connectors 4 other than 90 degrees are used. In some embodiments, other variations on orientation of the straps in such a rink, such as in FIG. 9, are included.

Figure 13:
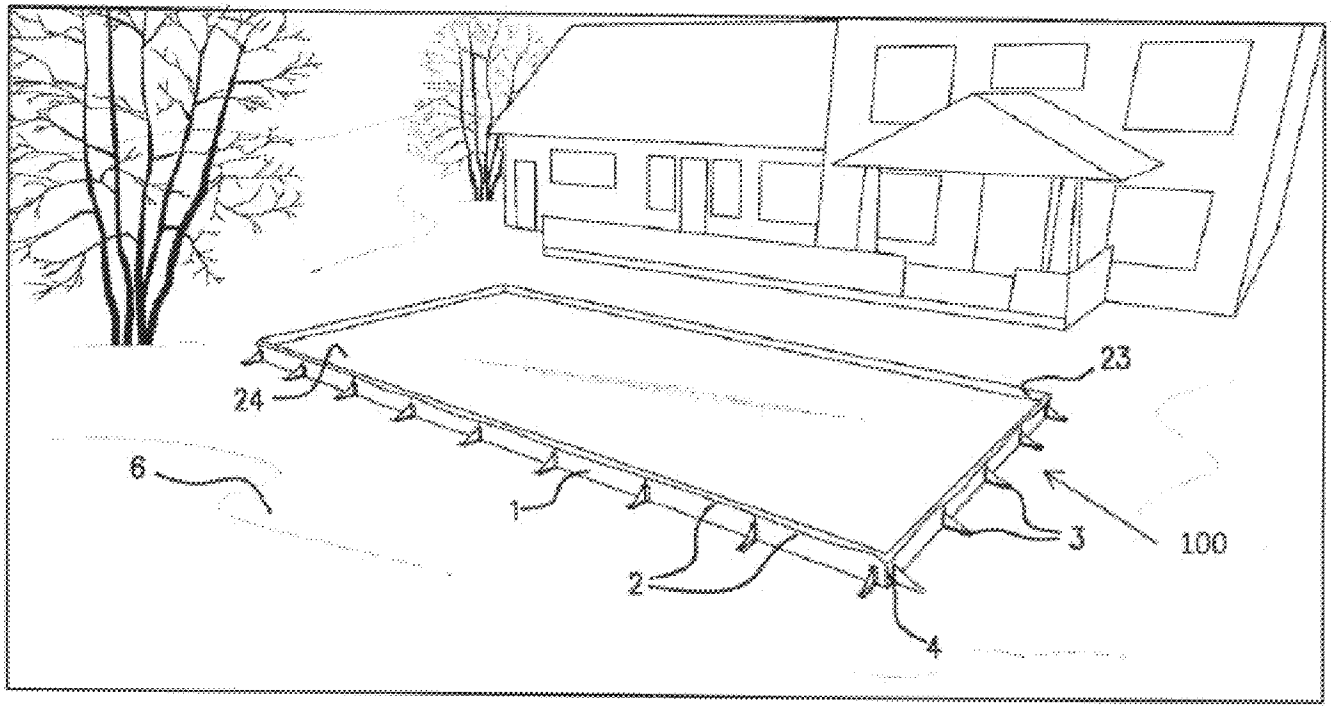
FIG. 13 is an isometric view of an ice skating rink structure according to the present disclosure installed on a residential lot.

FIG. 13 depicts one embodiment of the ice skating rink structure 100 of the present disclosure including ice on a residential lot. The side boards 1, board holding members 3, and corner connecting elements 4 define the perimeter of the rink installed on a horizontal surface (the ground) 6.

Figure 14:
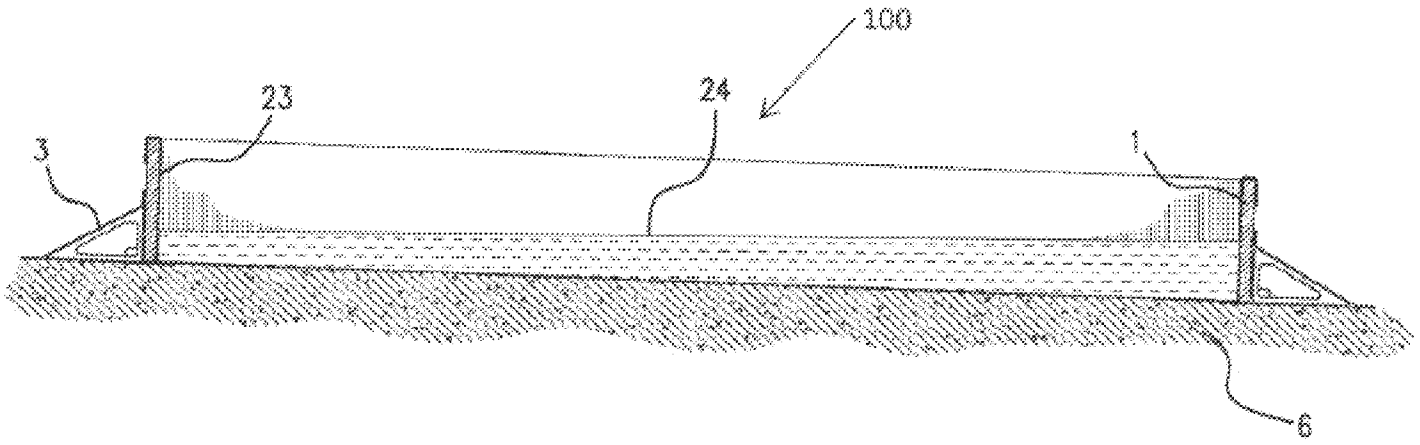
FIG. 14 is a cross sectional view of an ice skating rink structure according to the present disclosure including water that self-levels when installed on a semi-flat or sloping surface.
Figure 15:
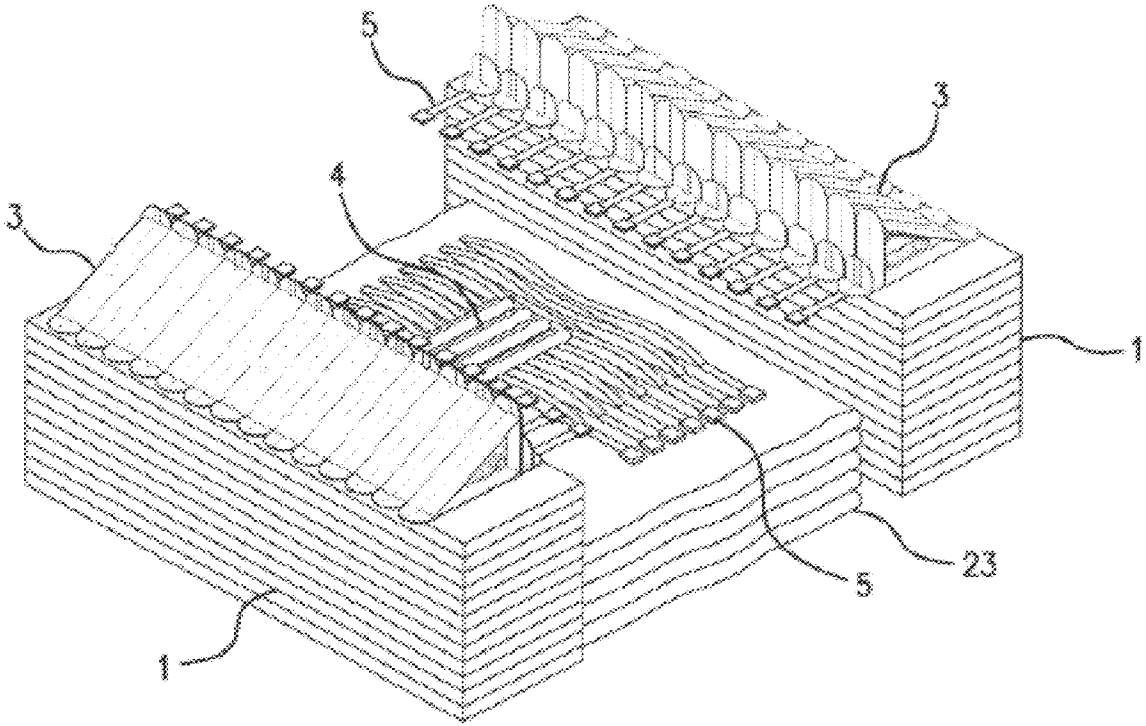
FIG. 15 depicts the components of an ice skating rink structure according to the present disclosure disassembled and stacked in a compact orientation.

Referring to FIG. 14, the water self-levels when installed on a semi-flat or sloping horizontal surface 6. The resulting ice 24 naturally forms the desired horizontal surface. Referring to FIG. 15, the components of the self-standing ice skating rink structure of the present invention. The depicted components are grouped as a kit.

In some embodiments, an ice skating rink structure disclosed herein includes one or more tension members and a perimeter component. These tension members act to hold the rink structure together. The perimeter component includes one or more side boards 1. The rink includes one or more board holding members. These board holding members can be spaced in between the boards or behind them and can be the supports that help keep the boards in a generally vertical orientation.

In some embodiments, the self-standing ice skating rink structure disclosed herein includes one or more, or alternatively a plurality, of tension members; a water-impermeable liner; and a perimeter component.

In some embodiments, the perimeter component includes a plurality of interlocking side boards.

In some embodiments the perimeter component is a single side board that is bendable upon itself and interlocks with itself to define the enclosure of the rink.

In some embodiments, the perimeter component includes one or more corner connecting components.

In some embodiments, the corner connecting components are adjustable to define a corner of a target angle. By a target angle is meant the desired angle that is sought for each corner of the rink. For example, for an essentially rectangular rink, the corner angles, i.e. four in this case, would each be about 90 degrees. In other embodiments, other target angles are selected. For example in a rink with "cut-off" corners such that the rink has an octagonal shape, the corner angles, i.e. eight in this case, would each be 135 degrees.

In some embodiments, the corner connecting components include an adjustable means such that the corner connecting components are adjustable to define a corner of a target angle.

In some embodiments, the adjustable means is a hinge. In some embodiments, the adjustable hinge is attached to one or more side boards.

In some embodiments, the rink structure includes a plurality of board holding members.

In some embodiments, each of said interlocking side boards comprises one or more integrated board holding members.

In some embodiments, the self-standing ice skating rink structure includes a plurality of tension members; a plurality of board holding members; a water-impermeable liner; and a perimeter component, comprising a plurality of interlocking side boards and one or more corner connecting components.

In some embodiments, the rink structure is positioned on an essentially horizontal surface. It is to be appreciated that the rink structure does not appreciate penetrate or insert into the essentially horizontal surface.

In some embodiments, the perimeter component defines an essentially rectangular, an essentially oval, or an essentially octagonal geometric shape wherein the interlocking side boards are connected with each other to form opposing side walls and where the side walls are connected to each other with four corner connecting components to form the corners of the rectangular geometric shape.

In some embodiments, the board holding member includes a flat base having an inner end and an outer end, an outer vertical element perpendicular to the base located a fixed distance from the outer end of the base, an inner vertical element perpendicular to the base and separated from and parallel to the outer vertical element and located a fixed distance from the inner end of the base or at the inner end of the base. The outer vertical element, inner vertical element and the intervening portion of the base define a U-shaped slot. A supporting buttress is connected to the outer surface of the outer vertical element and connected to the base a fixed distance from the outer end of the base or at the outer end of the base. The supporting buttress, outer vertical element, and the portion of the base between the outer vertical element and the supporting buttress define an essentially rectangular geometric shape, and a receiver oriented on the base and on the outer side of the squared cornered U-shaped slot for receiving the tension member.

In some embodiments, each board holding member is oriented such that the inner end of the base is directed to the interior of the essentially rectangular geometric shape of the rink and each side board is removeably and vertically engaged in the squared cornered U-shaped slot of the board holding member.

In some embodiments, a board holding member is positioned wherein each side board is connected to each other.

In some embodiments, an additional board holding member is positioned adjacent to where a side board is connected to a corner connecting component.

In some embodiments, the rink structure has an even number of board holding members, and the board holding members are oriented in opposing pairs directly across from each other.

In some embodiments, each of the tension members provides a tension traveling roughly perpendicular to the perimeter component and the tension members travel across the area of said rink and in contact with the horizontal surface and attach to the perimeter component on the opposite side of said rink.

In some embodiments, each tension member is connected to a pair of opposing board holding members.

In some embodiments, the tension member is connected to the board holding member via the receiver of the board holding member.

In some embodiments, the receiver is an aperture through which the tension member passes through and is removeably or permanently attached.

In some embodiments, the tension members are selected from cables, straps, wires or belts.

In some embodiments, the tension members comprise an attachable/detachable connecting means.

In some embodiments, the tension member is a strap or belt and the attachable/detachable connecting means is a buckle.

In some embodiments, each side board includes a first end and a second end. The first end includes a male connecting component and the second end includes a female connecting component.

In some embodiments, the male connecting component includes a protuberance and the female connecting component includes a plurality of fingers and a groove.

In some embodiments, the corner connector includes a male connecting component and a female connecting component oriented at a defined angle to each other, other than 180 degrees.

In some embodiments, the angle is 90 degrees.

In some embodiments, the male connecting component of the corner connector is a protuberance and the female connecting component of the corner connector is a groove.

In an aspect the present invention relates to a rink structure wherein the impermeable liner is oriented within the perimeter, in contact with the horizontal surface, on top of the tension members, and draped over the perimeter. The impermeable liner overlaps the side boards and the shape of the impermeable liner does not have to correspond to the shape of the perimeter of the rink. In some embodiments, the impermeable liner has a shape that is not complementary to the shape of the perimeter. In some embodiments, the impermeable liner is purposely larger than necessary to accommodate modification of the perimeter's shape and/or size.

In some embodiments, the rink structure includes a plurality of clips, such as for example U-clips, for removeably securing the impermeable liner to the side boards of the perimeter.

In some embodiments, each side board includes a handle.

In some embodiments, the handle is an aperture.

In some embodiments, the handle is a groove running parallel to the length of the side board.

In some embodiments, water or ice is contained within the impermeable liner.

In some embodiments, the rink rests on an underlying essentially horizontal surface without penetrating the surface.

In some embodiments, the rink requires no tools or hardware for assembly (or installation).

In some embodiments, the rink can be assembled (or installed) in about 60 minutes or less.

In some embodiments, the portable, self-standing ice skating rink structure, includes: one or more tension members, a plurality of board holding members, a water-impermeable liner, and a perimeter component, comprising a plurality of side boards.

In some embodiments, the portable, self-standing ice skating rink structure, including: one or more tension members; a water-impermeable liner; and a perimeter component. The perimeter component is made up of a plurality of interlocking side boards and one or more corner connecting components.

In some embodiments, a method of assembling a portable, self-standing ice skating rink structure, from a kit including: a plurality of tension members; a plurality of board holding members; a water-impermeable liner; and a perimeter component, comprising a plurality of interlocking side boards and one or more corner connecting components is disclosed herein.

In some embodiments, a method includes filling the water-impermeable liner with water, and allowing the water to freeze within the liner.

In some embodiments, a kit for constructing a portable self-standing ice skating rink structure as described herein and includes any combination of the recited components and variants thereof.

In some embodiments, an ice skating rink structure, includes one or more tension members and a perimeter component.

In some embodiments, the perimeter component includes one or more boards.

In some embodiments, the rink includes one or more board holding members.

In some embodiments, the rink includes an impermeable liner.

In some embodiments, the tension members are hoop or circumference stresses, oriented around the perimeter component.

In some embodiments, each of the board holding members has at least one support to hold one or more of said boards.

In some embodiments, each of the tension members provides a tension traveling roughly perpendicular to the perimeter component and the tension members travel across the area of the rink and attaches to the perimeter component on the opposite side of the rink.

In some embodiments, the tension members attach one or more of said board holding members together.

In some embodiments, said tension members are non-permanently attached to said board holding members.

In some embodiments, said tension members are permanently attached to said board holding members.

In some embodiments, said tension members are non-permanently attached to said boards. In some embodiments, said tension members are permanently attached to said boards.

In some embodiments, said tension members are composed of a material selected from rubber, fabric, rope, elastic material, metal, carbon fiber, wood, composites, or a combination thereof.

In some embodiments, said rink comprises an impermeable liner.

In some embodiments, said tension members are under the liner.

In some embodiments, said tension members are above the liner.

In some embodiments, said tension members travel through said liner.

In some embodiments, said liner acts as said tension members.

In some embodiments, said tension members are attached to the bottom of said liner.

In some embodiments, said tension members are attached to the top of said liner.

In some embodiments, said tension members are woven through one or more boards.

In some embodiments, said tension members are attached at an angle other than perpendicular to said perimeter component.

In some embodiments, said board holding members are non-permanently attached to said boards.

In some embodiments, said board holding members are permanently attached to said boards.

In some embodiments, said board holding members hold said boards in an upright position without attaching to the boards.

In some embodiments, said board holding members hold said boards together without attaching to the boards.

In some embodiments, said board holding members are continuous with said boards.

In some embodiments, board holding members are designed with a roughly perpendicular member to brace said boards against the ground.

In some embodiments, said board holding members are weighted.

In some embodiments, said board holding members attach to said boards beneath said boards.

In some embodiments, said board holding members attach to said boards above said boards.

In some embodiments, said board holding members attach to said boards between said boards.

In some embodiments, said board holding members attach to said boards through slots or holes in said boards.

In some embodiments, said board holding members attach to said boards by fully surrounding a portion of said boards.

In some embodiments, said liner travels over said boards and attaches to said board holding members.

In some embodiments, said liner travels beneath said boards and attaches to said board holding members.

In some embodiments, said liner attaches to said boards.

In some embodiments, said rink optionally comprises one or more board holding members which are staked into the ground.

In some embodiments, one or more of said boards has a curved cross-sectional profile.

In some embodiments, said boards have adjustable heights.

In some embodiments, said boards are non-permanently attached to one another.

In some embodiments, said boards are permanently attached to one another.

In some embodiments, said liner is temporarily water permeable.

In some embodiments, said liner is refrigerated.

In some embodiments, said liner is manufactured for use without ice and compatible with wheeled objects.

In some embodiments, said liner is removable.

In some embodiments, said liner is disposable.

In some embodiments, said board holding members hold one or more boards.

In some embodiments, said board holding members hold said boards at an angle formed between contiguous boards other than 180 degrees.

In some embodiments, said boards are attached to each other by hinges.

In some embodiments, said board holding members are attached to said boards by hinges.

In some embodiments, said boards act as said tension members.

In some embodiments, one or more of said tension members are not under tension.

In some embodiments, said boards form the perimeter of the ice rink.

In some embodiments, said tension members attach to the bottom of said board holding members.

In some embodiments, said tension members attach to the top of said board holding members.

In some embodiments, said tension members attach to the back of said board holding members.

In some embodiments, said tension members attach to the front of said board holding members.

In some embodiments, said tension members attach through said board holding members.

In some embodiments, said board holding members have a slot, clip, or other member with which to hold the board.

In some embodiments, said boards overlap each other.

In some embodiments, said tension members are unrolled with an unrolling mechanism.

In some embodiments, said boards connect to one another and can pivot to form an acute, obtuse, straight, reflex or right angle.

In some embodiments, said board holding members twist and lock into said boards.

In some embodiments, said tension members twist and lock into said board holding members.

In some embodiments, said tension members twist and lock into said boards.

In some embodiments, said water impermeable liner is oriented within the perimeter of said rink.

In some embodiments, said perimeter component is held in an upright and generally perpendicular position with respect to the ground.

In some embodiments, said perimeter component defines a rink selected from rectangular, rectangular with curved corners, rectangular with straight cut-off angled corners, circular, or oval in shape.

In some embodiments, said perimeter component comprises at least two or more boards oriented at opposing sides of the rink.

In some embodiments, there is more than one of said board holding members per respective board.

In some embodiments, one or more of said boards is self-standing.

In some embodiments, said rink is portable.

In some embodiments, said rink is self-standing.

In some embodiments, said rink rests on an underlying surface without penetrating said underlying surface.

In some embodiments, said rink is portable and self-standing.

In some embodiments, said rink requires no tools or hardware for installation.

In some embodiments a method of constructing an ice skating rink structure includes the steps of: providing a perimeter component; providing and attaching one or more tension members to said perimeter component; providing a water impermeable liner within said perimeter component; filling said liner with water, and allowing said water to freeze within said liner.

In some embodiments of the method, the perimeter component includes one or more board holding members and one or more boards.

In some embodiments, the method also includes the steps of attaching one or more board holding members to one or more boards in an alternating fashion to form the perimeter component.

The ice skating rink structure's tension members can act as hoop or circumference stresses, and can be oriented inside, outside or around the perimeter component. Each of said board holding members can have at least one support to hold one or more of said boards. Each tension member can provide a tension traveling roughly perpendicular to said perimeter components and the tension members can travel across the area of the rink and attach to the perimeter component on the opposite side of the rink.

Each tension member can attach one or more of said board holding members together. Each tension member can be permanently or non-permanently attached to said board holding members. These tension members can be permanently or non-permanently attached to the boards. The tension members are composed of a material selected from rubber, fabric, rope, elastic material, metal, carbon fiber, wood, composites, or a combination thereof.

The tension members can lie under or above the liner or can travel through the liner. The liner can act as said tension members. The tension members can be attached to the top or bottom of the liner for convenience of installation or some other purpose. The tension members can also be woven through one or more boards. The tension members can be attached at an angle other than perpendicular to said perimeter component.

The board holding members can be permanently or non-permanently attached to said boards. The board holding members can hold said boards in an upright position with or without attaching to the boards. The board holding members can hold said boards together with or without attaching to the boards. The board holding members can be continuous with the boards. The board holding members can be designed with a roughly perpendicular member to brace said boards against the ground. The board holding members can be weighted.

The board holding members can attach to said boards beneath, above or between the boards. The board holding members can attach to said boards by passing through slots or holes in the boards or by fully surrounding a portion of the boards.

The liner can travel over, beneath or through said boards and attach to said board holding members or the back side of the board. The liner can attach to said boards either above or below them.

The rink can optionally comprise one or more board holding members which are staked into the ground. This option is primarily for rinks on sloped ground. One or more of said boards can have a curved cross-sectional profile. The boards can have adjustable heights. The boards can be permanently or non-permanently attached to one another.

The liner can be temporarily water permeable to assist in removal of rink. The liner can be refrigerated to enhance ice formation and/or retention. The liner can be manufactured for use without ice such that it is compatible with wheeled objects, for example roller skates, skateboards or other devices. The liner can be removable and/or disposable.

The board holding members can hold one or more boards and can hold them at 180 degrees or any other angle including, but not limited to, acute, right, obtuse or reflex. The boards can be attached to each other by hinges. The board holding members can be attached to said boards by hinges. The boards can act as said tension members. All tension members must not always be under tension. Said boards can form the perimeter of the ice rink. Said tension members can attach to the bottom, top, back, or front of said board holding members. The tension members can attach through said board holding members.

The board holding members can have a slot, clip, or other member with which to hold the board. Said boards can overlap each other. The tension members can be unrolled with an unrolling mechanism. The boards can connect to one another and can pivot to form an acute, obtuse, straight, reflex or right angle.

The board holding members can twist and lock into said boards. For example, there can be a male and female end which attach or clip together. The tension members can twist and lock into said board holding members. The tension members can twist and lock into said boards.

The water impermeable liner can be oriented within the perimeter of the rink. The perimeter component can be held in an upright and generally perpendicular position with respect to the ground. The perimeter component can define a rink selected from rectangular, rectangular with curved corners, circular or oval in shape. The perimeter component can comprise at least two or more boards oriented at opposing sides of the rink. There can be more than one of said board holding members per respective board. One or more of said boards can be self-standing.

The ice skating rink structure can be one or more of the following: portable, self-standing, rest on an underlying surface without penetrating said underlying surface. The rink can require no tools or hardware for installation.

To install the rink, set up the perimeter component, attach tension members to said perimeter component, lay a water impermeable liner within said perimeter component, fill the liner with water, and allow water to freeze into ice. The perimeter component can comprise one or more board holding members and/or one or more boards. These board holding members and boards can interlock in an alternating fashion.

It is therefore an object of the present disclosure to provide an ice skating rink structure that is easy and quick to construct.

It is another object of the present disclosure to provide an ice skating rink structure that does not require penetration of the underlying surface so that it can be installed on any surface at any time of year.

It is a further object of the present disclosure to provide an ice skating rink structure that can be used on level ground, sloped ground, as well as bumpy ground.

It is another object of the present disclosure to provide an ice skating rink structure that can be installed and removed without causing great damage to the underlying surface.

It is another object of the present disclosure to provide an ice skating rink structure that can be re-used from season to season.

It is another object of the present disclosure to provide an ice skating rink structure that requires no tools for installation.

It is another object of the present disclosure to provide an ice skating rink structure that can be set up without penetrating the ground and also requires no compression members such as lumber or heavy sand bags to hold the board holding members, boards or liner in place.

It is another object of the present disclosure to provide an ice skating rink structure that can be modified for use on sloped lawns as opposed to flat hard surfaces.

It is another object of the present disclosure to provide an ice skating rink structure which can easily be constructed using boards made from either plastic, lumber, plywood, carbon fiber, fiberglass, composite or some other synthetic or other material.

It is another object of the present disclosure to provide an ice skating rink structure such that the boards which are used to form the perimeter of the rink require no holes, grooves or other modifications to allow them to connect with the provided board holding members.

Other objects and advantages of the present disclosure will become apparent as the description proceeds.

Figure 16:
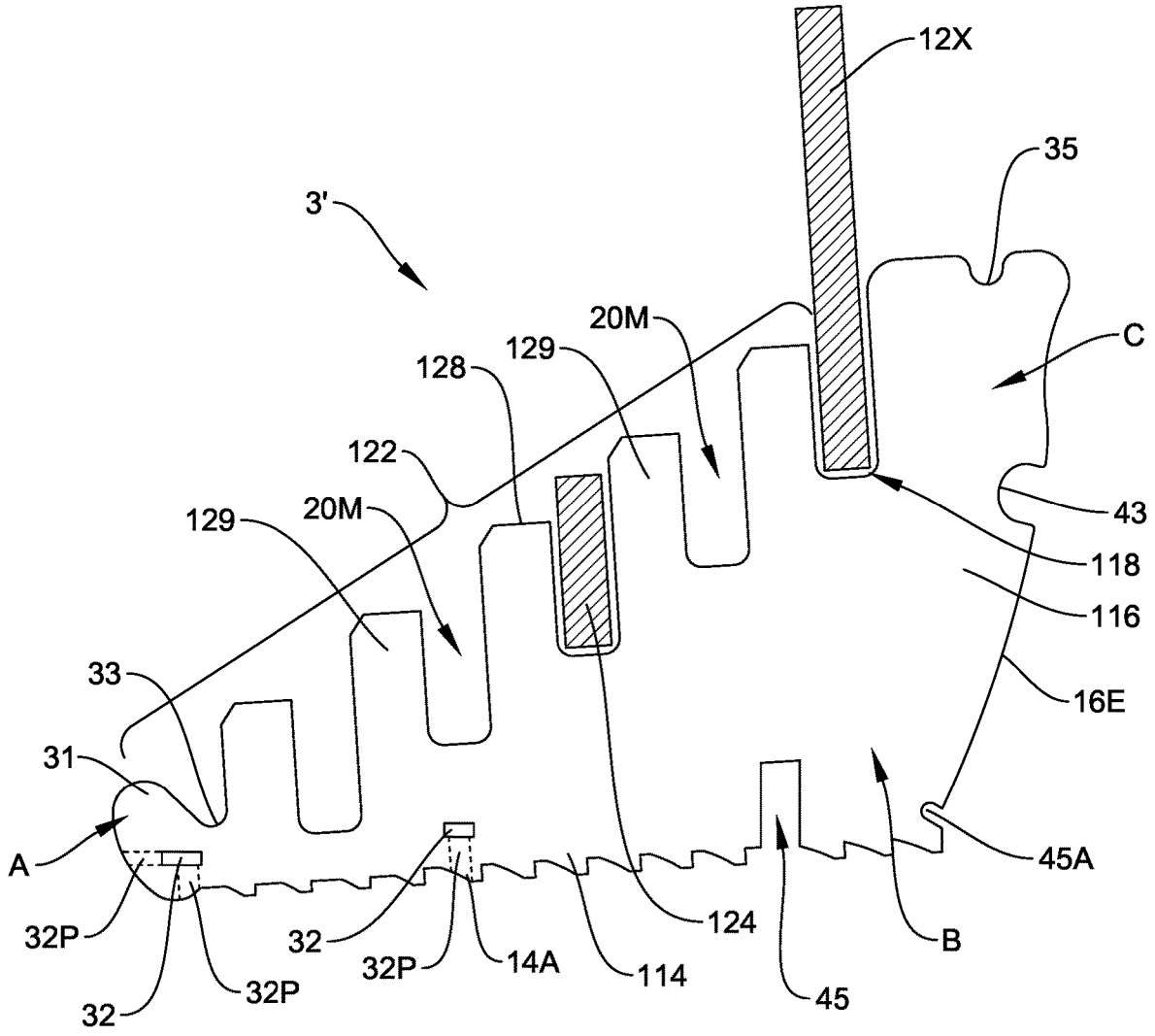
FIG. 16 depicts a front view of a first example of a support member according to the present disclosure.
Figure 17:
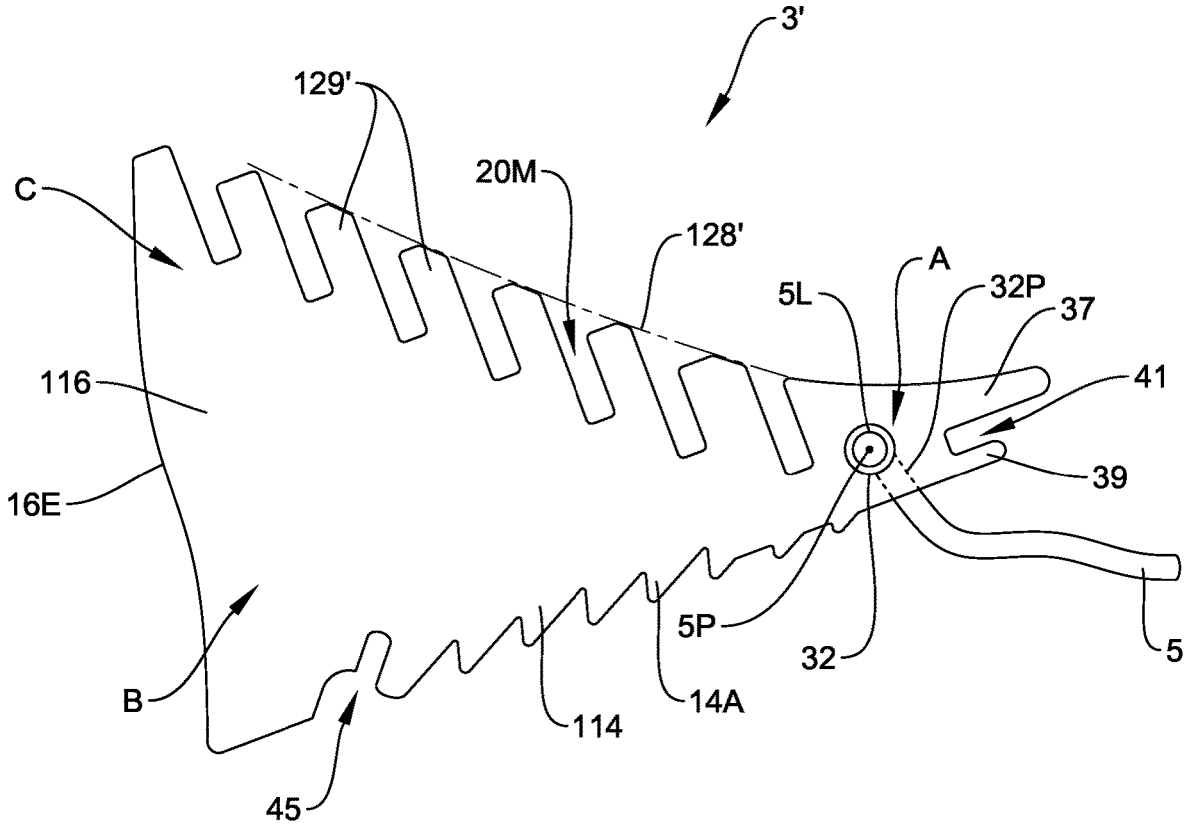
FIG. 17 depicts a front view of a second example of a support member according to the present disclosure.
Figure 18:
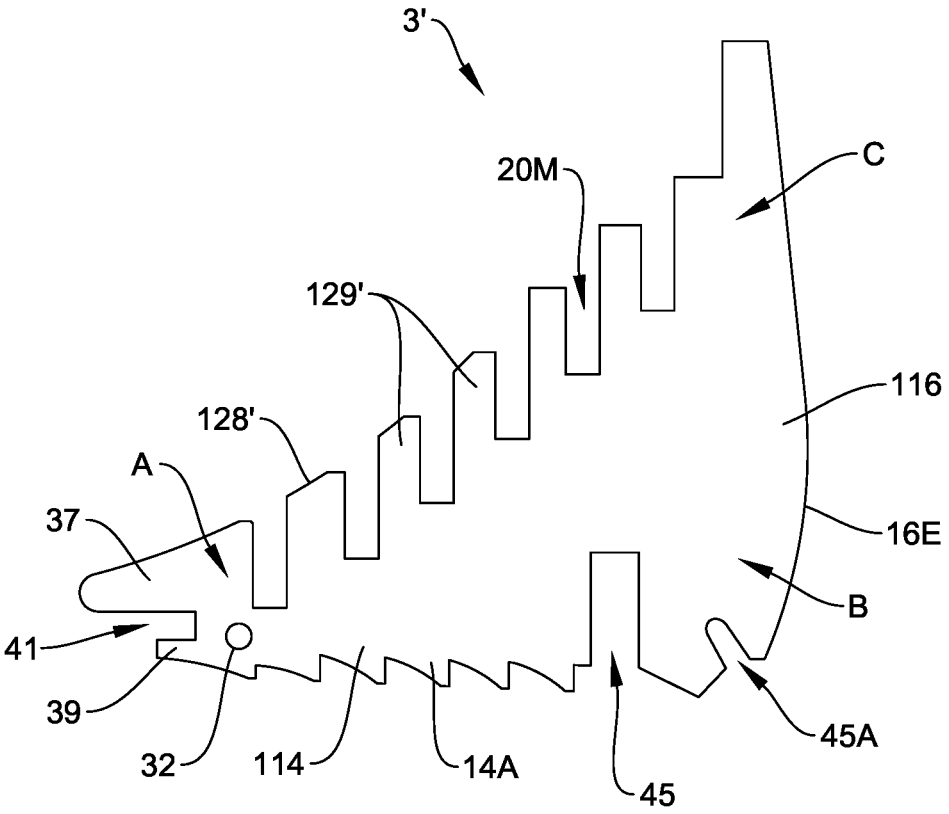
FIG. 18 depicts a front view of a third example of a support member according to the present disclosure.
Figure 21:
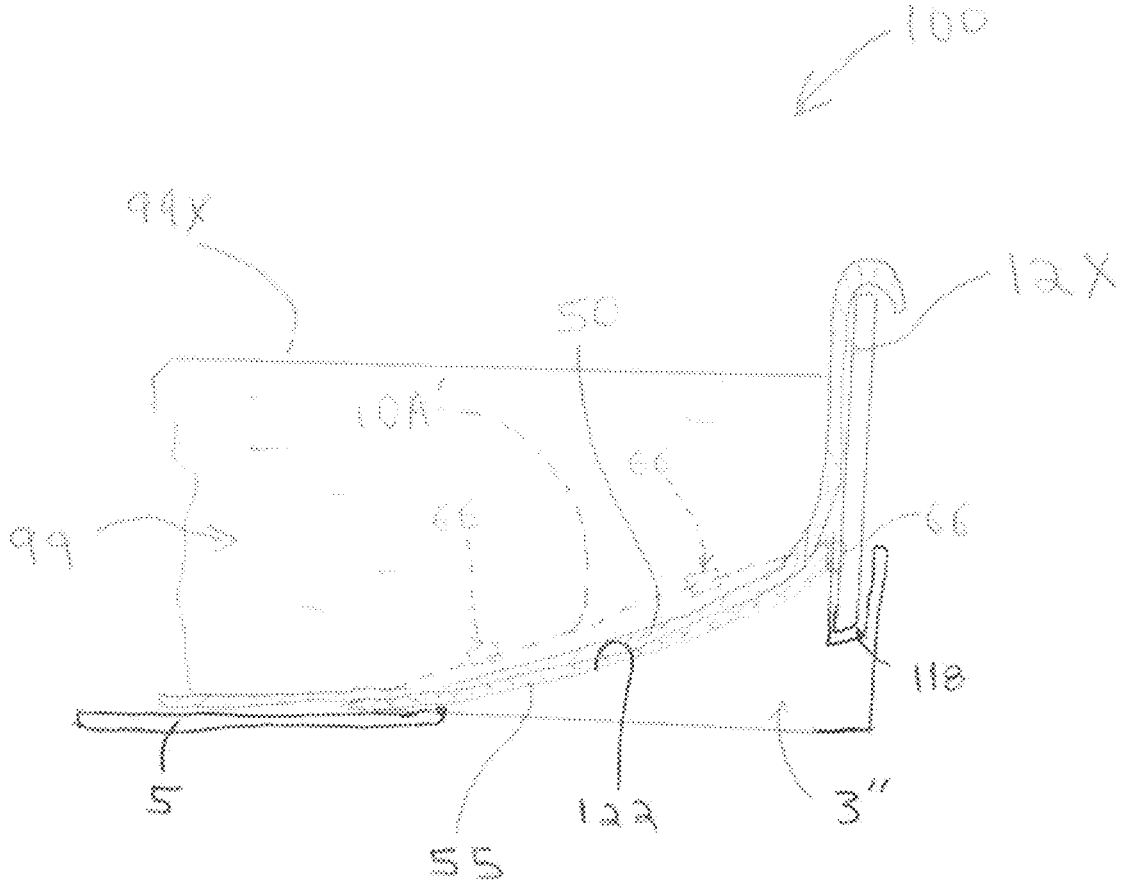
FIG. 21 is a cross sectional view of the retaining wall elevating structure of FIG. 5 taken across section 6-6.
Figure 28:
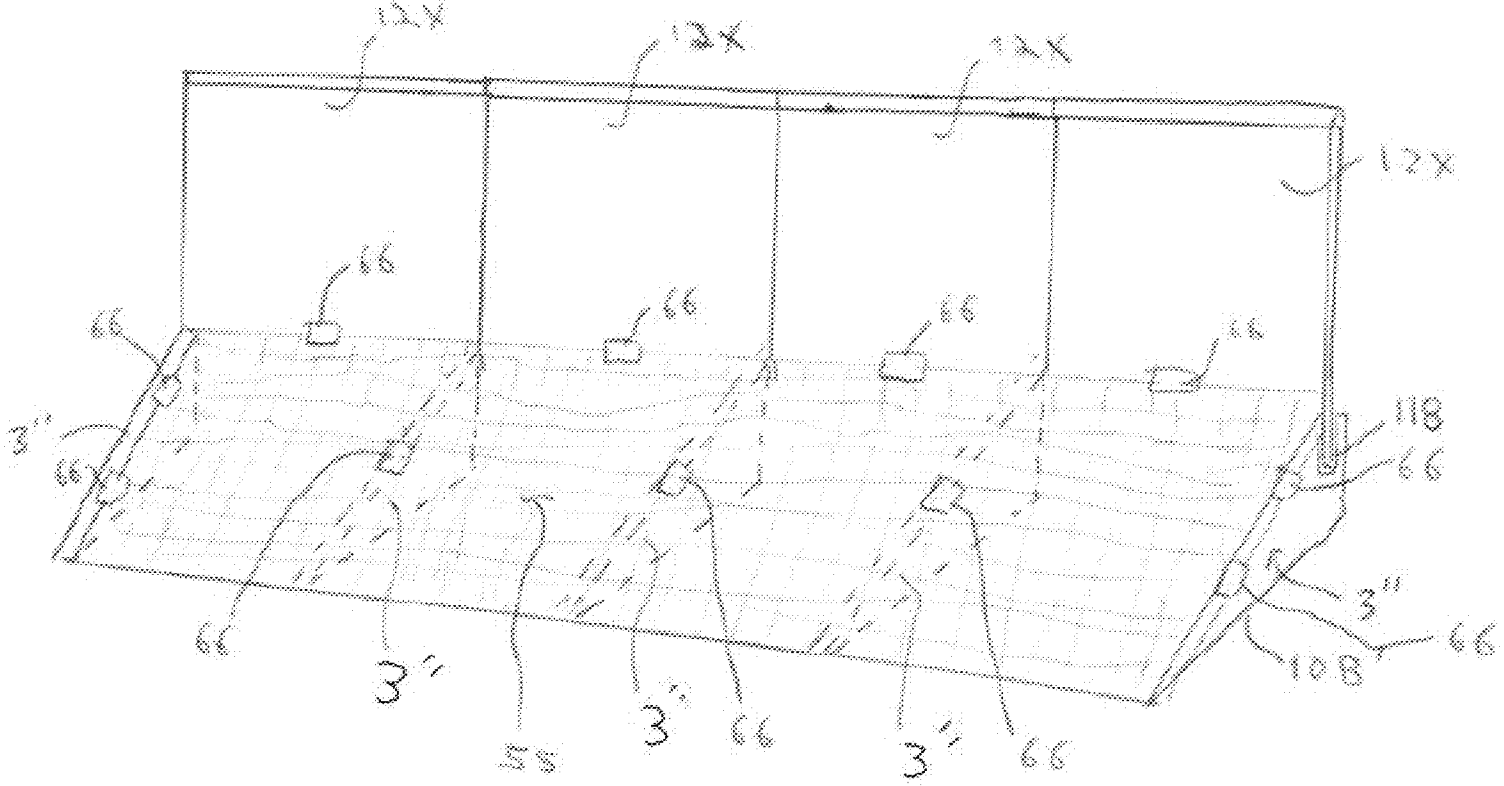

As shown in FIGS. 16 to 18, various embodiments of a support member 3' for elevating a retaining wall panel 12X of a portable ice skating rink, includes a base arrangement 114 having a first area A proximate to a first end of the support member and a second area B proximate to a second end opposite the first end. The base arrangement 114 engages a ground (e.g., lawn, asphalt, soil, etc.) or other mounting surface 1. A height elevating section 116 extends from the base arrangement 114 proximate to the second area B to a third area C. The height elevating section 116 defines a receiving area 118 that receives a wall panel 12X (see e.g., FIGS. 16 and 19). A stepped surface contour 128 extends between the base arrangement 114 proximate to the first area A and the height elevating section 116 proximate to the third area C. The stepped surface contour 128 defines a load bearing portion 122 (see e.g., FIGS. 16 and 19) extending between the first area A and the third area C. A liner 50 drapes over the load bearing portion 122 and the wall panel 12X, as shown in FIG. 21.

Figure 19:
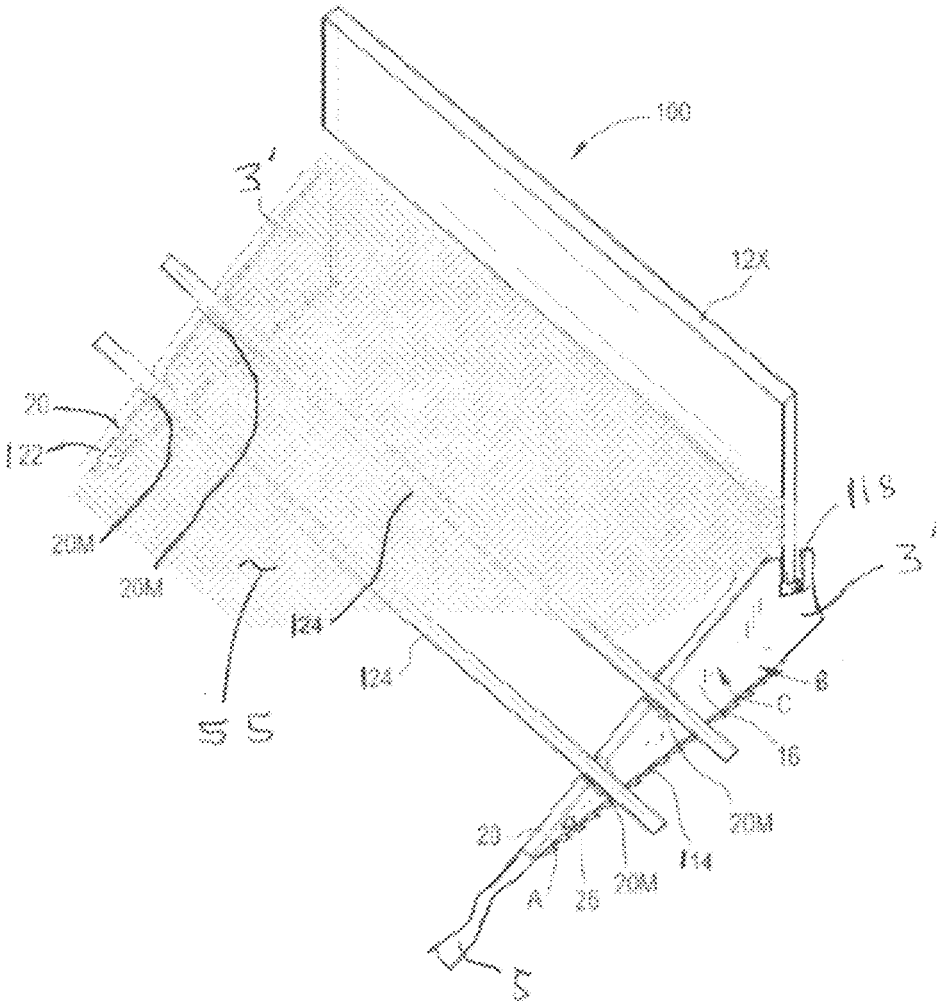
FIG. 19 depicts an isometric view of a retaining wall elevating structure with a portion of the load bearing portion omitted and a portion of the retaining wall elevating structure depicted in phantom.

As illustrated in FIG. 16, the stepped surface contour 128 includes one or more mounting areas 20M, each for receiving a lateral brace member 124 (e.g., a wooden two inch by four-inch piece of lumber, etc.) Referring to FIG. 19, the lateral brace member 124 is an additional support structure that engages the support member 3'. Some support members 3" shown in FIG. 20 omit the mounting areas 20M discussed previously.

In some examples, the support member 3' has an opening 32 located proximate to the first area A. In some embodiments, an internal channel 32P extends into the opening 32. A tension member 5 (see FIGS. 17 and 19) may be received through the opening 32 and the channel 32P and travel under the base arrangement 114 and ultimately travels under the water impermeable liner 50 (see FIG. 21) to connect to another support member 3, 3', 3" at an opposite end of the area 100A within the ice skating rink structure 100. In some embodiments, as best shown in FIG. 17, the tension member terminates in a fastener 5L (e.g., a loop) which is secured in the opening by an anchor 5P (e.g., a pin extending through the fastener 5L) thereby securing the fastener 5L in the opening 32.

As illustrated in FIG. 16, the opening 32 may be shaped as an elongated slot. Alternatively, FIGS. 17 and 18 illustrate an opening 32 that is circular in shape.

In the examples depicted in FIGS. 16 to 18, the base arrangement 114, the height elevating section 116, and the stepped surface contour 128 form a substantially triangular shape. Other shapes, such as a polygon, trapezoid, hexagon, etc., do not depart from the scope of the device disclosed herein.

The base arrangement 114 has an anti-skid feature 14A to increase the friction between the bottom of the base arrangement 114 and the mounting surface 1. In the depicted examples, the anti-skid feature 14A is a series of angled teeth extending from the base arrangement 114. Other features, such as pins, protrusions, ribs, or other means of increasing the friction between the base arrangement 114 and the mounting surface 1 (see FIG. 2) do not depart from the device disclosed herein. In other examples, the lower surface of the base arrangement 114 includes a surface roughness to increase friction with the mounting surface 1. In still other examples, the lower surface of the base arrangement 114 is substantially smooth. In the depicted examples, the support member 3' is a unitary body, but other arrangements do not depart from the devices disclosed herein. In still other examples, the base arrangement 114, the height elevating section 116, and the surface contour 128 are separate pieces connected to one another.

In the illustrated examples of FIGS. 16 to 18, the mounting areas 20M extend substantially perpendicularly with respect to the base arrangement 114. For example, lateral brace members 124 may be inserted into one or more of the mounting areas 20M in a direction that is substantially perpendicular to the base arrangement 114.

As shown in FIG. 16, the stepped surface contour 128 includes a plurality of stepped portions 129 (e.g., vertical legs), with one or more (e.g., all) of the stepped portions 129 being substantially perpendicular to the base arrangement 114. Portions (e.g., top edges) of one or more of the stepped portions 129' may be at least partially curved as shown in FIG. 17 (e.g., at a free end of the cantilever structure). Additionally, the mounting areas 20M formed between adjacent stepped portions 129 may have substantially the same depth, although other examples may include mounting areas 20M with different depths.

With continued reference to FIG. 16, the first area A may include a rounded and/or elongated shape. For example, the first area A may have a substantially elliptical shape. The elliptical portion 31 of the first area A may be oriented so that the major axis is substantially more vertical in use than the minor axis. A groove 33 may be formed between the elliptical portion 31 and one of the stepped portions 129. This groove 33 may be smaller in size than the mounting areas 20M, and thus may not support a lateral brace member 124, although the groove 33 may be large enough in other examples to support a lateral brace member 124 (and/or a different sized lateral brace member 124 may be used).

In some forms, the third area C may be larger than the first area A. The third area C may also be shaped similarly to the stepped portions 129, although the third area C may also be larger. In some examples, the third area C may form an end of the stepped surface contour 28. The third area C may also include a notch 35. The notch 35 may be oriented in substantially the same direction as the mounting areas 20M, although the depth of the notch 35 may be less than the depth of any one of the mounting areas 20M. The notch 35 may include a substantially smooth shape, although other shapes may also be used.

As shown in FIGS. 17 and 18, the support member 3' includes an overall curved contour 128' (e.g., a concave arcuate contour) that extends between the base arrangement 114 and the height elevation section 116. Like the surface contour 128 in FIG. 16, the curved contour 128' includes a plurality of stepped portions 129'. Unlike the stepped portions 129 in FIG. 16, a portion the stepped portions 129' in FIGS. 17 and 18 are at least partially inclined relative to the base arrangement 114 to form the curve between the base arrangement 114 and the height elevation section 116. The mounting areas 20M in FIGS. 17 and 18 have substantially the same depth, although any one of the mounting areas 20M may have different depths.

With continuing reference to FIGS. 17 and 18, the first area A may include a rounded and/or elongated shape. Unlike the elliptical shape 31 in FIG. 16, the first area A in FIGS. 17 and 18 may include a longer portion (e.g., a major axis) oriented at least partially parallel to the base arrangement 114. Additionally, the first area A may include an upper region 37 and a lower region 39. The upper region 37 may be larger than the lower region 39 and may be spaced apart from the lower region 39 by a gap 41. The gap 41 may be similar in size and/or shape to the mounting areas 20M. For example, one of the lateral brace members 124 could be received within the gap 41. The upper region 37 may also be more curved than the lower region 39. The curvature of the upper region 37 may correspond to the curvature of the curved contour 128'.

In some forms, the upper portion 37 in FIG. 17 may be larger than the upper portion 37 in FIG. 18. For example, the upper portion 37 in FIG. 17 may be longer and narrower and the upper portion 37 in FIG. 18 may be shorter and wider.

Each of the support members 3' illustrated in FIGS. 16 to 18 include an edge 16E of the elevating section 116. In each of the three examples, the edge 16E is curved between the second area B and the third area C. The curvature of each edge 16E may be at least partially convex. For example, the support member 3' of FIG. 18 includes an edge 16E that is substantially convex. Alternatively, the edges 16E in FIGS. 16 and 17 include at least a portion that is also concave. In still other examples (not shown), the edge 16E could be substantially or entirely concave.

As illustrated in FIG. 16, the edge 16E may include a channel 43, which may be at least partially circular in shape. The illustrated channel 43 is disposed proximate to a transition between a convex and concave curvature, although the channel 43 may be disposed at any location along the edge 16E.

Returning to FIGS. 16 to 18, the base arrangement 114 may include at least one discontinuity 45. The discontinuity 45 may form a break along the base arrangement 114 that is separate from the anti-skid feature 14A (see e.g., FIGS. 17 and 18). In other examples, the discontinuity may form a break in the anti-skid feature 14A (see e.g., FIG. 16).

As illustrated in FIGS. 16 and 18, the discontinuity 45 may have a substantially rectangular shape and may be disposed proximate to the third area C. For example, the discontinuity 45 may have a shape that is similar to the shape of the mounting areas 20M. Additionally, the discontinuity 45 may extend in a direction that is substantially parallel to the direction of the mounting areas 20M. However, other examples may include a discontinuity that is shaped and/or sized differently than the mounting areas 20M. As described above, the discontinuity 45 of FIG. 16 may be between a portion of the anti-skid feature 14A, while the discontinuity of FIG. 2 may be proximate to but separate from the anti-skid feature 14A.

As illustrated in FIG. 17, the discontinuity 45 may extend in a direction that is inclined relative to the base arrangement 114. For example, the discontinuity 45 may extend into the stepped portions 129' and the third area C. The discontinuity of FIG. 17 may be proximate to but separate from the anti-skid feature 14A. In certain forms, the discontinuity 45 and the anti-skid feature 14A may extend along substantially parallel axes. The discontinuity 45 of FIG. 17 may be at least partially curved and may be narrower than the discontinuity 45 of FIGS. 16 and 18.

In some forms, the support member 3' may further include a discontinuity 45A that is spaced apart from the discontinuity 45 described above. FIGS. 16 and 18 may specifically disclose this discontinuity 45A, which is positioned proximate to or on the edge 16E. The discontinuity 45A may be smaller than and/or angled relative to the discontinuity 45.

As shown in FIG. 19, a retaining wall elevating structure 100 incorporates the support members 3'. The load bearing portion 122 is disposed on the sloped surface 20 of the support members 3'. In the depicted embodiment, the load bearing portion 122 extends in a sloped manner between the mounting surface (e.g., the ground) proximate to the first area A and the height elevating section 116 proximate to the third area C. In the depicted example, the retaining wall elevating structure 100 includes a wall panel 12X positioned substantially vertically. A water impermeable liner 50 (see FIG. 21) drapes over the wall panel 12X and the load bearing portion 122. In the depicted embodiment, the load bearing portion 122 is disposed on and extends over two support members 3'. Two (optional) lateral brace members 124 extend between the support members 3'. The lateral brace members 124 provide further support for the load bearing portion 122. Other examples could include greater (e.g., three, four, etc.) or fewer (e.g., one or zero) lateral brace members 124.

In the illustrated example, the load bearing portion 122 is a net or similar tensionable structure. For example, the load bearing portion 122 may be constructed from a fibrous material and may be stretched over the two support members 3'. The load bearing portion 122 may be secured to one or more of the support members 3' to retain the tension in the net. Specifically, this may assist in ensuring that the water impermeable liner 50 is also substantially taut and does not sag because of being supported by load bearing portion 122.

In some forms, the lateral brace members 124 may extend between the two support members 3' and may provide additional support for the load bearing portion 122. In other words, the load bearing portion 112 may rest directly on the lateral brace members 124, although an additional structure (not shown) may be positioned between the load bearing portion 122 and the lateral brace members 124. The lateral brace members 124 provide support in the middle of the net to reduce slack. As described above, each support member 3' may include multiple mounting areas 20M. For example, each of the support members 3' illustrated in FIGS. 16 to 18 may have at least five mounting areas 20M. This may allow for more lateral brace members 124 to be used, which may decrease the total distance between adjacent lateral brace members 124. In other words, it may be easier to maintain tension in the net because of the additional and closely spaced lateral brace members 124.

In the illustrated example, the load bearing portion 122 may include fibers or other materials that form a pattern having several openings. The size of the openings may be substantially small so that load bearing portion while under tension can support the water impermeable liner (e.g., so that the liner does not sag into one of the openings).

In other examples, the load bearing portion 122 may be constructed from natural or synthetic fabric. The load bearing portion 122 may be formed as a sheet of material and not as a net with defined openings. The fabric could be treated with a water resistant and/or water repellant material.

Figure 20:
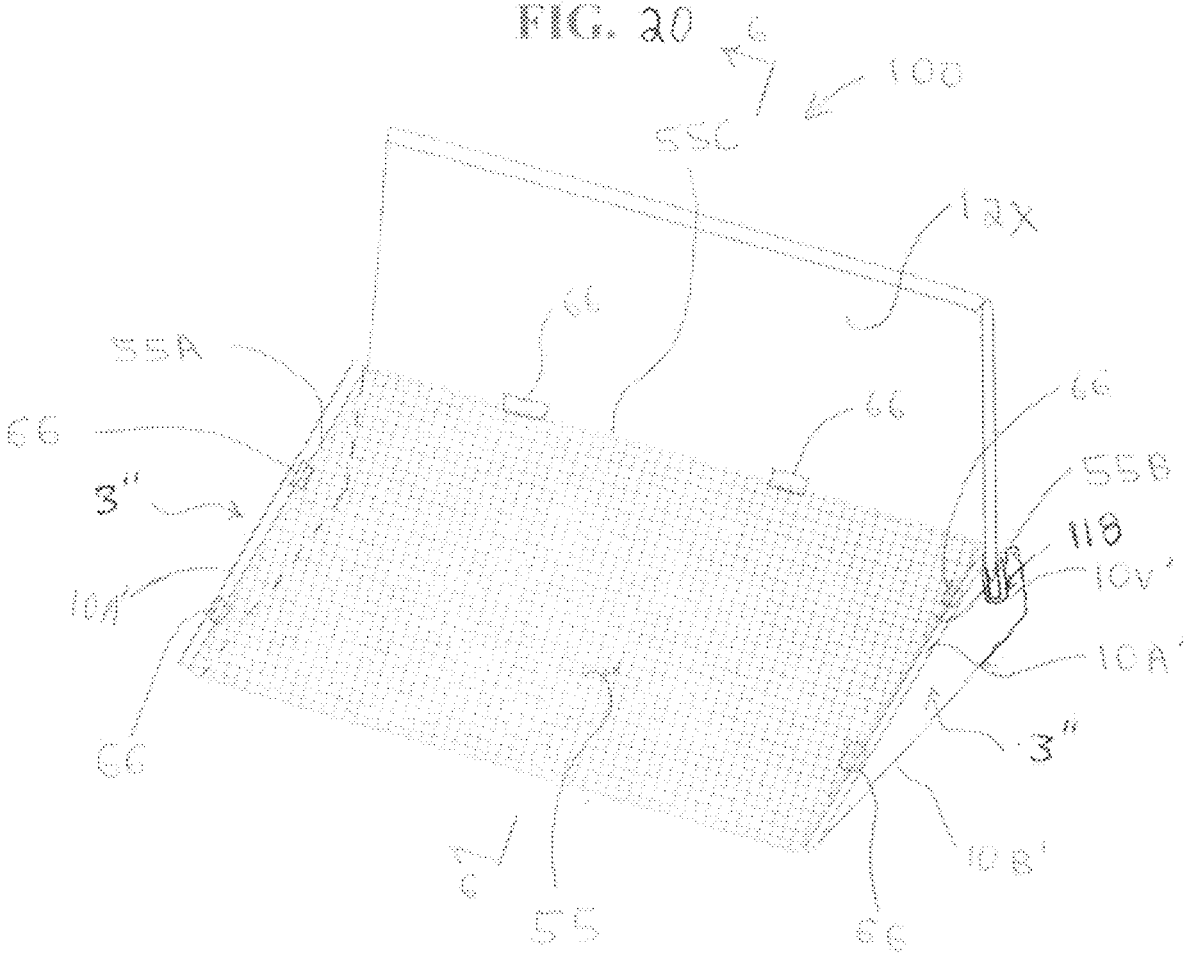
FIG. 20 depicts an isometric view of a retaining wall elevating structure and retaining wall with a flexible sheet secured thereto.

As shown in FIG. 20, a retaining wall elevating structure 100 incorporates support members 3" that are of a generally triangular shape with a base portion 10B' configured to be mounted on a receiving surface such as a lawn or asphalt paved surface. The support members 3" have a substantially vertical section 10V' extending upward from the base portion 10B'. The support members 3" have a sloped portion 10A' extending between an upper edge of the vertical portion 10V' and an edge of the base portion 10B'. The support members 3" support a wall panel 12X in a substantially vertical position along the vertical section 10V' of the support member 3". A flexible sheet 55 is removably secured to the wall panel 12X and the support members 10A'. For example, a lateral edge 55C of the flexible sheet 55 is secured to the wall vertical face of the wall panel 12X by one or more fasteners 66; and opposing side edges 55A, 55B of the flexible sheet 55 are secured to sloped portion 10A' of the respective support member 3" by a fastener system that includes one or more fasteners 66.

The flexible sheet 55 is manufactured from a net, natural or synthetic fabric, stretchable material, or plastic. The fasteners 66 include hooks, clamps, ties, hook and loop fasteners, screws, washers, plate strips and magnets. As shown in FIG. 21, a water impermeable liner 50 is draped over the flexible sheet 55 and over the top edge of the wall panel 12X. The water impermeable liner 50 is configured to contain water 99 which can freeze and form an ice-skating surface 99X. The flexible sheet 55 cooperates with the water impermeable liner 50 to support the weight of the water 99. In some embodiments the flexible sheet 55 is integral with, embedded in or secured to a portion of the impermeable liner 50. In some embodiments, as shown in FIG. 22, the flexible sheet extends over and is attached to multiple support members 3" by fasteners 66.

The disclosure is not limited to the foregoing illustrative examples and the examples should be considered in all respects as illustrative and not restrictive, reference being made to the appended claims, rather than to the foregoing examples, and all changes which come within the meaning and range of equivalency of the claims are therefore intended to be embraced.

The entire disclosure of each of the patent documents, including certificates of correction, patent application documents, scientific articles, governmental reports, websites, and other references referred to herein is incorporated by reference herein in its entirety for all purposes. In case of a conflict in terminology, the present specification controls.

The disclosure can be embodied in other specific forms without departing from the spirit or essential characteristics thereof. The foregoing embodiments are to be considered in all respects illustrative rather than limiting on the invention described herein. In the various embodiments of the present disclosure, where the term comprises is used, it is also contemplated that the embodiments consist essentially of, or consist of, the recited steps or components. Furthermore, the order of steps or the order for performing certain actions is immaterial as long as the invention remains operable. Moreover, two or more steps or actions can be conducted simultaneously.

In the specification, the singular forms also include the plural forms, unless the context clearly dictates otherwise. Unless defined otherwise, all technical and scientific terms used herein have the same meaning as commonly understood by one of ordinary skill in the art to which this invention belongs. In the case of conflict, the present specification will control.

What is claimed is:

1. A support member for elevating a retaining wall panel of a portable ice skating rink, the support member comprising:

a base arrangement being configured to engage a mounting surface;

a height elevating section extending from the base arrangement, the height elevating section having a first receiving area configured to receive a wall panel;

a surface extending between the base arrangement and the height elevating section, the surface having a plurality of mounting areas each being configured to receive a lateral brace member.

2. The support member of claim 1, wherein the base arrangement has an anti- skid feature formed as a series of angled teeth.

3. The support member of claim 1, wherein each mounting area of the plurality of mounting areas extends along an axis oriented perpendicularly with respect to the base arrangement.

4. The support member of claim 1, wherein a mounting area of the plurality of mounting areas includes a first slot that extends along a first axis, and wherein the first receiving area includes a second slot that extends along a second axis parallel to the first axis.

5. The support member of claim 1, wherein the surface includes a plurality of spaced apart stepped portions and a mounting area of the plurality of mounting areas is formed between two adjacent stepped portions, wherein each stepped portion of the plurality of stepped portions is formed as a cantilever structure and is at least partially curved at a free end.

6. The support member of claim 1, wherein the height elevating section includes a curved edge.

7. A retaining wall system for elevating a retaining wall panel of a portable ice skating rink, the retaining wall system comprising:

a first support member;

a second support member spaced apart from the first support member;

a load bearing portion extending between the first support member and the second support member, wherein the load bearing portion is a net; and a water impermeable liner supported by the load bearing portion;

further comprising a brace extending between the first support member and the second support member, wherein the brace is configured to support the net.

8. The retaining wall system of claim 7, wherein the first support member and the second support member are configured to support a wall panel in a substantially vertical orientation and the net is removably secured to at least one of the first support member, the second support member and the wall panel by a fastener system.

9. The retaining wall system of claim 7, wherein first support includes an anti-skid feature formed as a series of angled teeth configured to engage a mounting surface.

10. The retaining wall system of claim 7, wherein the first support member includes a first slot and the second support member includes a second slot, and wherein the brace is received within the first slot and the second slot.

11. The retaining wall system of claim 7, wherein the first support member includes an opening with an internal channel and wherein a tensioning member is connected to the first support member through the opening and the internal channel, wherein the tensioning member is configured to increase tension across the net.

12. The retaining wall system of claim 7, wherein:

the first support member includes a first inclined surface;

the second support member includes a second inclined surface; and the net is at least partially supported by the first inclined surface and the second inclined surface.

13. A retaining wall system for elevating a retaining wall panel of a portable ice skating rink, the retaining wall system comprising:

a first support member;

a second support member spaced apart from the first support member;

a flexible sheet extending between the first support member and the second support member; and a water impermeable liner supported by the flexible sheet;

further comprising a brace extending between the first support member and the second support member, wherein the brace is configured to support the net.

14. The retaining wall system of claim 13, wherein the first support member and the second support member are configured to support a wall panel in a substantially vertical orientation and the flexible sheet is removably secured to at least one of the first support member, the second support member and the wall panel by a fastener system.

15. The retaining wall system of claim 13, wherein first support includes an anti-skid feature formed as a series of angled teeth configured to engage a mounting surface.

16. The retaining wall system of claim 13, wherein the first support member includes a first slot and the second support member includes a second slot, and wherein the brace is received within the first slot and the second slot.

17. The retaining wall system of claim 13, wherein the first support member includes an opening with an internal channel and wherein a tensioning member is connected to the first support member through the opening and the internal channel, wherein the tensioning member is configured to increase tension across the net.

18. The retaining wall system of claim 13, wherein:

the first support member includes a first inclined surface;

the second support member includes a second inclined surface; and the net is at least partially supported by the first inclined surface and the second inclined surface.

19. A retaining wall system for elevating a retaining wall panel of a portable ice skating rink, the retaining wall system comprising:

a first support member;

a second support member spaced apart from the first support member;

a load bearing portion extending between the first support member and the second support member, wherein the load bearing portion is a net; and a water impermeable liner supported by the load bearing portion;

wherein the first support member includes an opening with an internal channel and wherein a tensioning member is connected to the first support member through the opening and the internal channel, wherein the tensioning member is configured to increase tension across the net.

20. A retaining wall system for elevating a retaining wall panel of a portable ice skating rink, the retaining wall system comprising:

a first support member;

a second support member spaced apart from the first support member;

a load bearing portion extending between the first support member and the second support member, wherein the load bearing portion is a net; and a water impermeable liner supported by the load bearing portion;

wherein:

the first support member includes a first inclined surface;

the second support member includes a second inclined surface; and the net is at least partially supported by the first inclined surface and the second inclined surface.

21. A retaining wall system for elevating a retaining wall panel of a portable ice skating rink, the retaining wall system comprising:

a first support member;

a second support member spaced apart from the first support member;

a flexible sheet extending between the first support member and the second support member; and a water impermeable liner supported by the flexible sheet;

wherein the first support member includes an opening with an internal channel and wherein a tensioning member is connected to the first support member through the opening and the internal channel, wherein the tensioning member is configured to increase tension across the net.

22. A retaining wall system for elevating a retaining wall panel of a portable ice skating rink, the retaining wall system comprising:

a first support member;

a second support member spaced apart from the first support member;

a flexible sheet extending between the first support member and the second support member; and a water impermeable liner supported by the flexible sheet;

wherein:

the first support member includes a first inclined surface;

the second support member includes a second inclined surface; and the net is at least partially supported by the first inclined surface and the second inclined surface.

* * * * *